US005539145A

United States Patent [19]

Kuribayashi et al.

[11] Patent Number: 5,539,145

[45] Date of Patent: Jul. 23, 1996

[54] TONE DATA RECORDING AND REPRODUCING DEVICE

[75] Inventors: Hirotaka Kuribayashi; Hironari Kobayashi; Takashi Hirakata; Kazuhiro Gotoh; Yoshio Fujita, all of Hamamatsu, Japan

[73] Assignee: Yamaha Corporation, Japan

[21] Appl. No.: 466,605

[22] Filed: Jun. 6, 1995

Related U.S. Application Data

[62] Division of Ser. No. 29,021, Mar. 10, 1993.

[30] Foreign Application Priority Data

Mar. 10, 1992 [JP] Japan ..... 4-87629

[51] Int. Cl.[6] ..... G10H 7/00; G10H 1/36

[52] U.S. Cl. ..... 84/602; 84/604; 84/609; 84/645

[58] Field of Search ..... 84/600–604, 609–614, 84/634–638, 645

[56] References Cited

U.S. PATENT DOCUMENTS

| | | | |
|---|---|---|---|
| 4,418,598 | 12/1983 | Klynas | 84/1.03 |
| 4,936,184 | 6/1990 | Yang | 84/612 |
| 5,029,120 | 7/1991 | Brodeur et al. | 364/718 |
| 5,127,303 | 7/1992 | Tsumura et al. | 84/609 |
| 5,138,925 | 8/1992 | Koguchi et al. | 84/609 |
| 5,313,011 | 5/1994 | Koguchi | 84/609 |
| 5,393,926 | 2/1995 | Johnson | 84/610 |

*Primary Examiner*—Vit W. Miska
*Attorney, Agent, or Firm*—Graham & James

[57] ABSTRACT

A record and reproduction controlling device is connected to a hard disk memory via a bus. This controlling device receives from a computer information necessary for read/write operation, on the basis of which the controlling device performs its own process to write to or read from the hard disk. The record and reproduction controlling device temporarily stores tone data read out from the hard disk memory into a first buffer memory and then transfers the tone data from the first buffer memory to a second buffer memory. The tone data thus stored in the second memory is then read out at a predetermined readout rate to reproduce a musical sound. It is possible to select either a first reproduction mode for reproducing a data file having tone data of plural channels recorded in an interleaved state, or a second reproduction mode for permitting a simultaneous reproduction of plural data files each having not-interleaved tone data recorded therein. The controlling device controls the tone data transfer from the first buffer memory to the second buffer memory depending on which of the reproduction modes is employed.

6 Claims, 16 Drawing Sheets

RECORD CONTROL SECTION RC

REPRODUCED SOUND GENERATION SECTION TG

TONE DATA RECORDING AND REPRODUCING DEVICE

This is a division of application Ser. No. 08/029,021, filed on Mar. 10, 1993.

BACKGROUND OF THE INVENTION

This invention relates to a tone data recording and reproducing device which allows tone data such as waveform data to be recorded into and reproduced from a mass storage device such as a hard disk device.

Mass storage devices such as a hard disk device are commonly employed for recording tone waveform data that are sampled from the outside through a microphone or the like. In such a case, read/write operation of the hard disk is entirely managed or controlled by a general purpose control device like a personal computer. Namely, address management for data written into or read from the hard disk is entirely done by the personal computer program, and operations to record and reproduce tone waveform data are entirely controlled by the personal computer program.

In a reproduction process, for example, waveform data rapidly read out from the hard disk device are temporarily written into a buffer RAM (hereinafter, the term "RAM" represents a random access memory), and individual write addresses to write to the buffer RAM are also prepared by means of the personal computer program. The waveform data thus temporarily written into the buffer RAM are then read out in accordance with predetermined reproduction sampling clock pulse so as to reproduce sounds.

The above-mentioned prior art is however disadvantageous in that, since record and reproduction of the waveform data to and from the hard disk are entirely performed by the general purpose control device, i.e., personal computer, the personal computer is excessively bound by such record and reproduction processes, which very often presents a serious obstacle when it performs other processes in parallel with the record and reproduction processes. In the reproduction process, particularly, it is preferable to be able to not only reproduce sounds but also perform, in parallel therewith, various other additional functions such as a sequencer automatic performance function or a computer graphic function associated with a music piece performed. But, if the personal computer is bound by the record and reproduction of the waveform data to and from the hard disk, it becomes difficult or impossible for the personal computer to execute such an additional function in parallel with the record and reproduction processes. In order to eliminate the disadvantage, the computer must be substantially expanded in scale, or new programs permitting the required parallel execution must be developed.

Further, with the prior art technique, because arrangements are made such that the waveform data rapidly read out from the hard disk device are merely temporarily stored into the buffer RAM so as to allow the data to be read out in accordance with the predetermined reproduction sampling clock pulse, recorded contents in the hard disk device are wholly transferred to the buffer RAM and directly read out therefrom. Therefore, specific processes must be done in order to read out the waveform data transferred to and stored into a certain address range of the buffer RAM in accordance with the predetermined reproduction sampling clock pulse, thus requiring troublesome management of read addresses etc. Furthermore, up to now, any technique has not been proposed or considered which is adapted to properly dealing with special processes, such as a process for simultaneously reproducing different waveform data through plural channels or a process for simultaneously reproducing data in which waveform data of plural channels are interleaved.

Furthermore, in the prior art, waveform data (audio data) to be successively generated in a data file are stored successively so that the waveform data are read out in a successive manner to reproduce sounds. It may be considered that automatic performance data represented in MIDI format are stored in the same data file as the waveform data in such a manner that the automatic performance data can be performed along with the waveform data of the data file, but it is customary that the MIDI data are all stored together in the head portion of the data file. In such a case, the MIDI data read out from the data file are stored into a buffer RAM, so that, when reading the waveform data, the MIDI data are read out in parallel with the waveform data to thereby generate automatic performance sequence sound. However, if, in this case, the waveform data stored in the data file are ones requiring a relatively long reproduction time, the MIDI data must also cover the long reproduction time, and hence an considerably large amount of the MIDI data must be stored in the buffer RAM. Accordingly, the buffer RAM of a large capacity is required.

The IEEE Journal published in 1981 contains a treatise "Delayed Playback Music Synthesis Using Small Computers" written by Hal Chamberlin, which discloses the use of floppy disk storage for recording and reproducing audio data. But, it does not disclose any solution to the above-mentioned problems.

SUMMARY OF THE INVENTION

It is therefore an object of the present invention to provide a tone data recording and reproducing device which permits data record and reproduction processes without imposing a burden on a host control device that manages a mass storage device.

It is another object of the present invention to provide a tone data recording and reproducing device which can effectively simplify reproduction-related processes that are performed to read out data recorded in a mass storage device for reproduction thereof and which can properly deal with special processes such as a process for simultaneously reproducing different waveform data through plural channels or a process for simultaneously reproducing data in which waveform data of plural channels are interleaved.

It is still another object of the present invention to provide a tone data recording and reproducing device which, when tone waveform data having a relatively great amount of data are to be stored in a data file, allows related MIDI data, control data etc. (namely, non-waveform data) to be efficiently stored for proper utilization during reproduction.

A tone data recording and reproducing device according to one aspect of the present invention comprises a mass storage device attached to a host control device so as to be controlled thereby, and a record and reproduction controlling device connected to a data bus of the mass storage device for direct access thereto, the record and reproduction controlling device receiving from the host control device information designating a storage area of the storage device on which a write or read operation is to be performed and instructing, on the basis of the received information, the mass storage device to write to or read from the storage area, the record and reproduction controlling device further preparing an address signal synchronous with the write or read operation on the storage area and controlling a supply of tone data to be recorded in said storage device in accordance with the address signal or a fetch of tone data read out from the mass storage device.

According to the above-mentioned tone data recording and reproducing device, the mass storage device (such as a hard disk device) is attached to the host control device (such as a personal computer) so as to be controlled by the host control device, and it includes the record and reproduction controlling device that is provided separately from the host control device. This record and reproduction controlling device is connected to the data bus of the mass storage device for direct access thereto, and the controlling device receives from the host control device information designating a storage area of the storage device on which a write or read operation is to be performed. The record and reproduction controlling device instructs, on the basis of the received information, the mass storage device to write to or read from the storage area. The controlling device further prepares an address signal synchronous with the write or read operation on the storage area and controls a supply of tone data to be recorded in said storage device in accordance with the prepared address signal or a fetch of tone data read out from the mass storage device.

Therefore, when tone data is recorded into or reproduced from the mass storage device, the host control device only needs to manage the storage areas of the mass storage device and to give the record and reproduction controlling device storage area instructing information (such as information instructing the head address of a storage area to be accessed for write or read purpose). Because the record and reproduction controlling device itself performs actual read/write instructions to the mass storage device, preparation of address signal synchronous with the read/write instructions and control of supply/fetch of tone data based on the address signal, a burden on the host control device can be reduced to a considerable degree. In consequence, the host control device can execute various other additional functions such as a sequencer automatic performance function or a computer graphic function associated with a music piece performed (as by directly using existing programs), thus achieving enhanced functions during a reproductive performance.

A tone data recording and reproducing device according to the second aspect of the present invention comprises a storage device for storing tone data, a first buffer memory into which the tone data read out from the storage device is fetched, a second buffer memory to which the tone data fetched into the first first memory is transferred, a transfer control section for controlling a transfer of the tone data from the first buffer memory to the second buffer memory, and a readout section for reading out the tone data stored in the second buffer memory, at a desired readout rate.

According to the above-mentioned tone data recording and reproducing device, tone data read out from the storage device is temporarily fetched into the first buffer memory, from which the tone data is transferred to the second buffer memory. Then, the tone data thus stored in the second buffer memory is read out at a desired readout rate to reproduce a tone. Therefore, the first buffer memory is suitable for storing the entire recorded contents in the storage device; for example, it may be of a relatively large storage capacity. The second buffer memory, on the other hand, is suitable for read purpose; it may for example have such a configuration as to store one block of data having a predetermined size. Thus, the first and second buffer memories can be well fit for the fetch of the tone data from the storage device and the reproductive readout of the tone data, respectively. In this manner, the tone data readout from the second buffer memory can be done with ease by simply reading out one block of data of the predetermined size in accordance with a predetermined reproduction sampling clock pulse. Consequently, in performing real-time readout of the tone data in accordance with the reproduction sampling clock pulse, cumbersome readout address management is unnecessary, and thus it is made possible to effectively simplifying the reproduction systems employed.

A tone data recording and reproducing device according to the third aspect of the present invention comprises a storage device having a data file composed of tone data of plural channels recorded therein in an interleaved state, a first buffer memory into which the tone data read out from the storage device is fetched, an interleave cancellation section for reading out the tone data from the first buffer memory and releasing the read-out tone data from the interleaved state so as to provide separate tone data for each of the channels, a second buffer memory for storing, separately for each of the channels, interleaved-state-released tone data provided from the interleave cancellation section, and a readout section for reading out the tone data stored in the second buffer memory.

According to the above-mentioned tone data recording and reproducing device, the interleave cancellation section releases the tone data from the interleaved state so as to provide separate tone data for each of the channels. The interleaved-state-released tone data is stored into the buffer memory separately for each of the channels. Accordingly, data composed of waveform data of plural channels can not only be stored into the storage device but also be simultaneously reproduced in a proper manner.

A tone data recording and reproducing device according to the fourth aspect of the present invention comprises a storage device containing plural data files each having tone data recorded therein, a selection section for selecting a simultaneous reproduction of the plural data files, a readout control section for reading out, a predetermined data data unit at a time, from the storage device the tone data of the plural data files selected via the selection section, a buffer memory for storing respective tone data of the data files read out from the storage device, and a readout section for reading out the respective tone data of the data files stored in the buffer memory.

According to the above-mentioned tone data recording and reproducing device, tone data of plural data files recorded in the storage device are read out in predetermined units and stored into the buffer memory so that reproductive tone generation is achieved by reading out the respective tone data of the data files. This permits a simultaneous reproduction of the tone data of plural data files recorded in the storage device. Therefore, by selecting various combinations of the data files, a wide variety of reproductive performances can be achieved as desired.

A tone data recording and reproducing device according to the fifth aspect of the present invention comprises a storage device storing plural data files each having tone data recorded therein, a section for selecting either of a first mode for reproducing the data file having the tone data of plural channels recorded therein in an interleaved state, a second mode for permitting a simultaneous reproduction of plural data files each having not-interleaved tone data recorded therein, a first buffer memory to which the tone data read out from the storage device is fetched, a second buffer memory having plural predetermined storage areas, a first transfer control section for, in the first mode, reading out the tone data from the first buffer memory and releasing the read-out tone data from the interleaved state, so as to store interleaved-state-released tone data into the storage areas of the second buffer memory separately for the individual channels, a second transfer control section for, in the second mode, reading out the tone data of the individual data files from the first buffer memory so as to store the tone data into the respective store areas, and a readout section for reading out the tone data stored in the respective-storage areas of the second buffer memory.

According to the above-mentioned tone data recording and reproducing device, it is possible to select either a first reproduction mode for reproducing a data file having tone data of plural channels recorded therein in an interleaved state, or a second reproduction mode for permitting a simultaneous reproduction of plural data files each having not-interleaved tone data recorded. The tone data transfer from the first buffer memory to the second buffer memory is properly controlled depending on which of the reproduction modes is employed. In this way, in the first mode, the interleaved-state-released tone data for plural channels are separately stored into the respective storage areas of the second buffer memory, while, in the second mode, the tone data of the individual data files are stored into the respective storage areas. The readout section only needs to simply read out the tone data from the respective storage areas of the second buffer memory, and different readout controls for the two modes are not needed. Thus, with a very simple arrangement, it is made possible to perform a reproduction process that properly deals with the two modes.

A tone data recording and reproducing device according to the sixth aspect of the present invention comprises a first storage section storing waveform data of a tone to be successively reproduced in plural separate data groups and also storing non-waveform data between storage areas in which the waveform data of the individual groups are stored, a section for sequentially reading out the data stored in the first storage section and separating the waveform data from the non-waveform data, a second storage section for storing the separated waveform data, a readout section for sequentially reading out the waveform data stored in the second storage section so as to generate a reproduced tone, and a buffer storage section for temporarily storing the non-waveform data read out from the first storage section for subsequent utilization.

According to this tone data recording and reproducing device, non-waveform data are dispersedly stored between tone waveform data groups. Therefore, the size of one unit of the non-waveform data stored in the buffer storage means can be relatively small. In addition, because only the waveform data are separately retrieved and stored into the second storage section and this second storage section is accessed for readout purposes even though the non-waveform data are stored between the individual waveform data groups, successive tone generation can be reliably guaranteed. An example of the non-waveform data may be automatic performance sequence data represented in well-known MIDI format.

Now, preferred embodiments of the present invention will be described in greater details with reference to the accompanying drawings.

DESCRIPTION OF THE PREFERRED EMBODIMENT

Description of the Overall System

Figure 1:
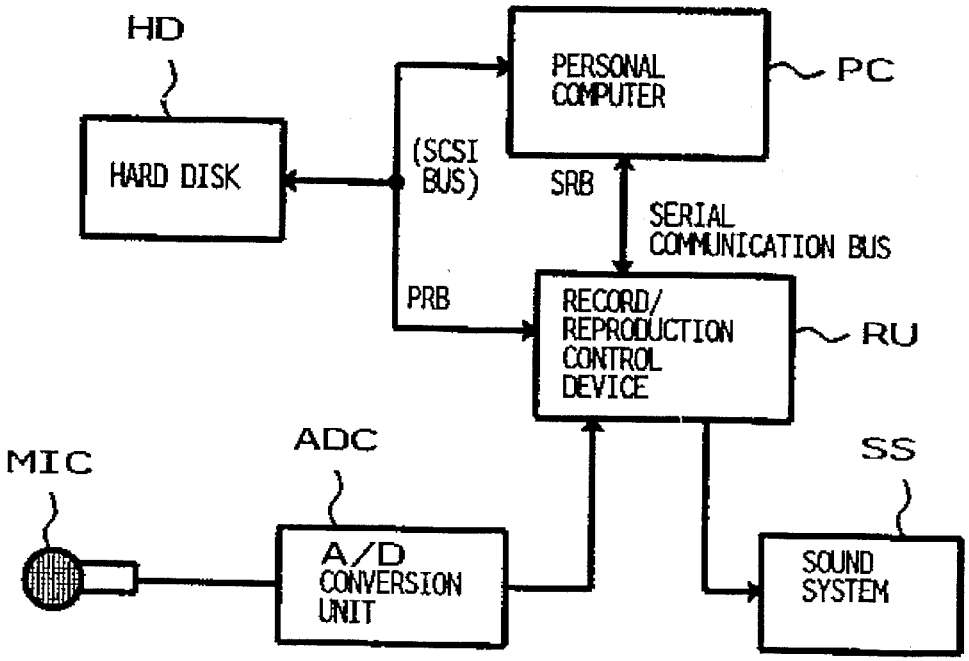
FIG. 1 is a block diagram illustrating an example of the overall system structure of a tone data recording and reproducing device according to the present invention.

FIG. 1 illustrates the overall system structure of a tone data record/reproduction device according to the present invention, in which a personal computer PC is employed as a host control device. A hard disk HD is provided as a mass storage device which is attached to the personal computer PC, and its storage files are control led or managed by the computer PC using a conventionally known method. A record/reproduction control device RU which comprises an unit independent of the personal computer PC performs controls to write tone data into the hard disk HD and to read out the written tone data for reproduce tone.

The record/reproduction control device RU is connected to the hard disk HD via a predetermined parallel bus PRB based on the SCSI (acronym of Small Computer System Interface) standard or the like in such a manner that it can directly access the data bus of the hard disk HD. Further, the record/reproduction control device RU is connected to the personal computer PC via a predetermined serial communication bus SRB based on the RS232C standard in such a manner that it can make a data exchange with the personal computer PC. Via the serial communication bus SRB, this control device RU, for example, receives from the personal computer PC data instructing a specific storage area of the hard disk HD on which data write or read should be done. On the basis of such storage area instructing data, the record/reproduction control device RU acts as an initiator for the hard disk HD that is connected therewith via the SCSI bus and instructs the hard disk HD to carry out data write or data readout with respect to the instructed storage area. Further, the control device RU prepares address signals synchronous with the write or readout operation with respect to the storage area and controls the supply of tone data to be recorded into the hard disk HD in accordance with the address signal or controls the fetch of tone data read out from the hard disk HD.

In this system, desired sound signal can be sampled from the outside through a microphone MIC. The sound signal picked up by the microphone MIC, may be then converted into digital waveform data by an analog-to-digital converter unit ADC so as to be input to the record/reproduction control device RU. The record/reproduction control device RU records the digital waveform data, namely, tone data given from the analog-digital converter unit ADC, into an storage area that is instructed by the computer PC in such a manner as previously mentioned. As commonly known, data recorded in the hard disk HD are assigned desired unique file names, and they are controlled by means of the computer PC for each data file. Operation to select a desired file name may be done, for example, by the player operating an operation panel belonging to the record/reproduction control device RU so that the selected file name is notified to the personal computer PC by way of the serial communication bus SRB, or may be done by operating a keyboard belonging to the personal computer PC.

When a desired data file of tone data is to be read out for reproducing tone, the corresponding file name is, as mentioned above, selected through the panel operation on the record/reproduction control device RU or the keyboard operation on the personal computer PC. The record/reproduction control device RU receives from the personal computer PC storage area instruction data, on the basis of which it reads out the tone data from the hard disk HD. The read-out digital tone data are then converted into analog signal and output to a sound system SS through which the data are audibly reproduced.

General Description on the Record/Reproduction Control Device RU

Figure 2:
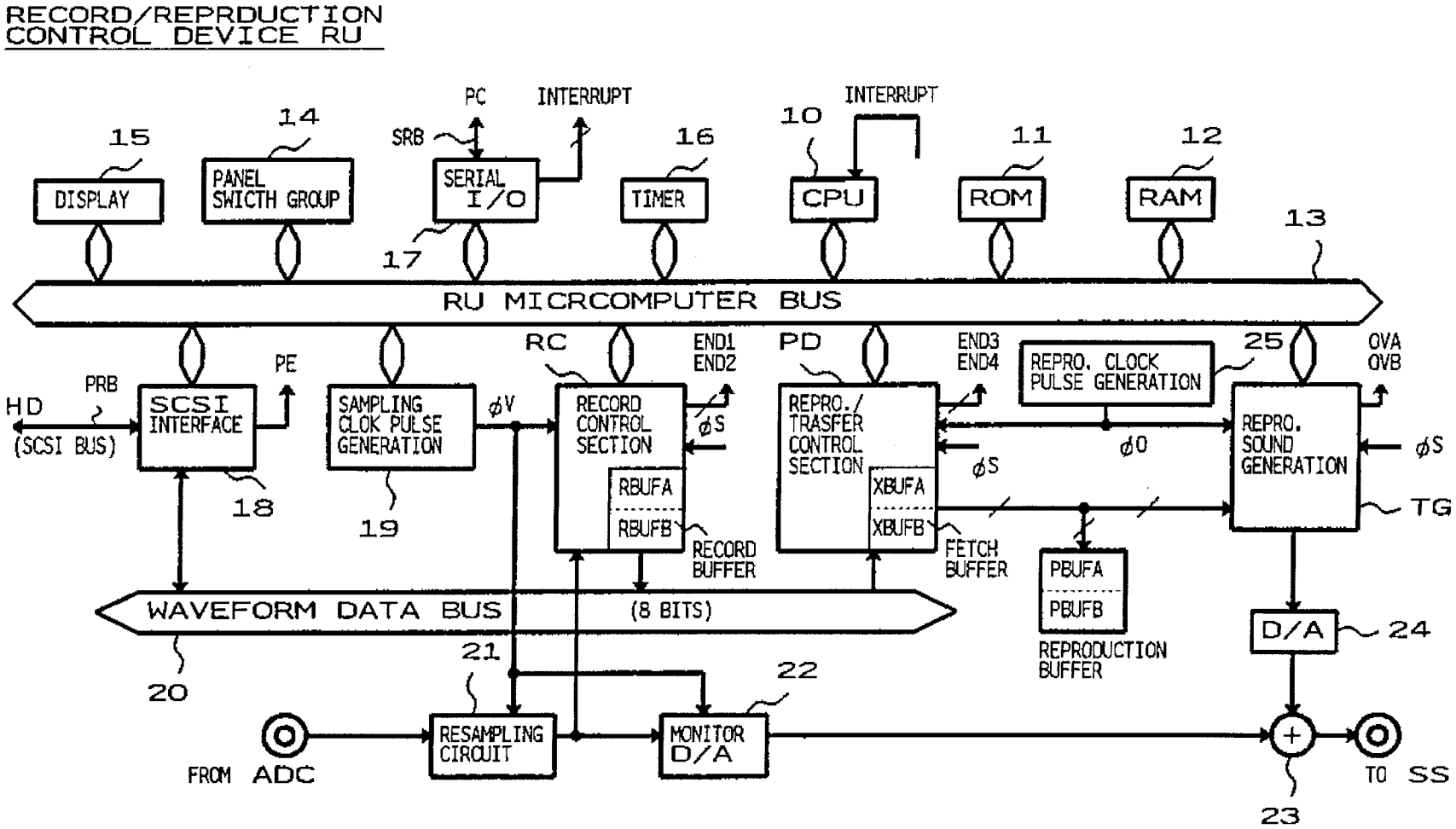
FIG. 2 is a functional block diagram illustrating an embodiment of a record/reproduction control device shown in FIG. 1.

An example structure of the above-mentioned record/reproduction control device RU will now be described in more details with reference to FIG. 2.

The record/reproduction control device RU performs its record/reproduction operations under the control of a microcomputer which typically comprises a central processing unit (CPU) 10, a read-only memory (ROM) having various programs and data stored therein, a random access memory (RAM) 12 used as a data-storing and working memory. To a bus 13 of the microcomputer 13 are connected a group of panel switches 14, a display circuit 15, a timer 16, an input/output port 17 for the serial communication bus SRB, a SCSI interface 18 for the SCSI-standard parallel bus PRB, a sampling clock pulse generation circuit 19, a record control section ARC, a record/transfer control section PAD, a reproduced sound generation section TG etc., so that respective operations of all these components are controlled by the microcomputer.

The record control section ARC performs controls to record tone data into the hard disk HD. Through the controls by this record control section ARC, tone data to be recorded into the hard disk HD are temporarily stored into a record buffer memory RBUFA, RBUFB and data thus recorded in the buffer memory RBUFA, RBUFB are then read out therefrom and given via a waveform data bus to the SCSI interface 18, from which the data are input via the SCSI bus PRB to the hard disk HD.

Data sampled from the outside through the microphone MI, are given from the above-mentioned analog-to-digital conversion unit ADC, via a resampling circuit 21, to the record buffer memory RBUFA, RBUFB for storage therein. The sampling clock pulse generation circuit 19 is capable of generating record sampling clock pulse $\phi_v$ at any one of plural record sampling frequencies in accordance with selection by an operator. The three record sampling frequencies selectable by the operator are for example 48 kHz, 44.1 kHz (sampling frequency for a CD (compact disk)), 36 kHz and 32 kHz (sampling frequency for a DAT (digital audio tape) and BS (broadcasting by satellite). With the three selectable record sampling frequencies, it is possible to effectively meet diversified needs of the users.

In accordance with the record sampling clock pulse $\phi_v$ generated from the sampling clock pulse generation circuit 19, the record control section ARC writes data into the record buffer memory RBUFA, RBUFB. The resampling circuit 21 resamples tone waveform sample data to be given from the analog-to-digital conversion unit ADC to the buffer memory RBUFA, RBUFB, in accordance with the record sampling clock pulse $\phi_v$. Because of this resampling by the circuit 21, the sampling frequency of tone waveform sample data to be written into the record buffer memory RBUFA, RBUFB can be conformed (or adjusted) to a writ sampling frequency, so as to effectively prevent an unwanted alising noise.

It should be understood that the tone waveform sample data to be written into the buffer memory may be converted into analog signal by a monitoring digital-to-analog converter 22 and output through a mixing adder 23 to the sound system SS. In this manner, tone to be recorded can be generated for monitoring purpose. In such a case, the record sampling clock pulse $\phi_v$ is used as sampling clock pulse for the digital-to-analog converter 22.

The reproduction/transfer control section PAD performs controls to read and retrieve or fetch desired tone data from the hard disk HD and also to transfer the fetched tone data for the purpose of tone reproduction. Because of the controls made by the reproduction/transfer control section PAD, tone data that are read out from the hard disk HD and given via the SCSI bus PRB, SCSI interface 18 and waveform data bus 20 are temporarily fetched into a fetch buffer memory XBUFA, XBUFB. In addition, the tone data thus fetched into the fetch buffer memory XBUFA, XBUFB are transferred to and stored into a reproduction buffer memory PBUFA, PBUFB while undergoing an appropriate transfer control such as a control for transferring the data a predetermined data block unit at a time.

The reproduced sound generation circuit TG reads out the tone data stored in the reproduction buffer memory PBUFA, PBUFB at a predetermined reproductive readout rate and in accordance with predetermined reproduction sampling clock pulses, so as to reproduce sound signals corresponding to the tone data. The read-out tone data are converted into analog signals by a digital-to-analog converter 24 and are output through the mixing adder 23 to the sound system SS.

A reproduction clock pulse generation circuit 25 generates reproduction sampling clock pulse $\phi_o$. The reproduction sampling clock pulse $\phi_o$ are of a constant frequency, for example, 48 kHZ. Since, as previously mentioned, the record sampling frequency can freely be selected from among plural sampling frequencies, the reproduced sound generation section TG determines a reproductive readout rate in correspondence to the record sampling frequency of the tone waveform data to be read out from the reproduction buffer memory PBUFA, PBUFB and the predetermined reproductive sampling frequency, in such a manner that the recorded tone waveform is properly reproduced at a constant reproduction sampling frequency. The reproductive readout rate corresponds to a phase change rate that determines the pitch of waveform which is read out at sampling timings according to the predetermined reproduction sampling frequency. The reproductive readout rate is determined basically by the ratio between the record sampling frequency and the predetermined reproduction sampling frequency, and it is further determined by the ratio between the pitch of recorded original tone and a desired pitch of reproduced tone. If, for example, waveform data sampled at a frequency of 48 kHz for recording is read out in accordance with reproduction sampling clock pulses of 48 kHz, the ratio determining the basic reproductive reading rate is "1", which is modified in correspondence to a desired relative pitch of reproduced tone (ratio with respect to the pitch of recorded original sound). If waveform data sampled at a frequency of 44.1 kHz for recording is read out in accordance with reproduction sampling clock pulses of 48 kHz, then the ratio determining the basic reproductive reading rate is "44.1/48", which is further modified in correspondence to a desired relative pitch of reproduced tone.

According to this embodiment, the buffer memory means employed for fetching the tone data read out from the hard disk HD and for reproducing the retrieved data are arranged in two stages that comprises the fetch buffer memory XBUFA, XBUFB and reproduction buffer memory PBUFA, PBUFB. Such a two-stage arrangement is very convenient in that it can greatly simplify the memory read process intended for sound generation in the reproduced sound generation section TG.

More specifically, while the fetch buffer memory XBUFA, XBUFB of the first stage must store entire data (which may include control data such as heading data in addition to tone waveform data) read out from the hard disk HD as they are, the reproduction buffer memory PBUFA, PBUFB of the second stage is capable of storing only necessary tone data after having applied a proper transfer control such as a control for arranging the data into one block data of a predetermined size. In this manner, it is readily made possible to achieve such a simple arrangement in which, for tone reproduction, the one block data of the predetermined size only need to be read out from the reproduction buffer memory PBUFA, PBUFB in accordance with a predetermined reproduction sampling clock pulses. Therefore, when real-time readout is made for tone generation in accordance with the reproduction sampling clock pulse, the need for a cumbersome read-out address management can be eliminated, and thus it is made possible to simplify memory read-out processes intended for sound generation in the reproduced sound generation section TG. Further, even in the case where tone waveform reproduction is done through plural channels, it is made possible to effectively simplify reproductive readout process for each channel in the reproduced sound generation section TG by constructing the reproduction buffer memory PBUFA, PBUFB in correspondence to the individual channels.

As shown, each of the record, fetch and reproduction buffer memories RBUFA, RBUFB, XBUFA, XBUFB, PBUFA, PBUFB is composed of two memory sections indicated by suffix characters A and B. Because of this, write to and readout from each of the buffer memories can be simultaneously done in a parallel manner by alternately performing the write and readout in the two memory sections.

It should be appreciated that these buffer memories RBUFA, RBUFB, XBUFA, XBUFB, PBUFA, PBUFB are shown in the figure in terms of their functions and may be implemented, for example, within the RAM 12 in an actual hardware structure.

It may also be apparent that the digital-to-analog converters 22 and 24 can be implemented by a single digital-to-analog converter. In such a case, if fixed reproduction sampling clock pulses $\phi_o$ are used as sampling clock pulses for the single digital-to-analog converter, output of the resampling circuit 21 may be resampled by the sampling clock pulses $\phi_o$ to be given to the single digital-to-analog converter.

Description on the Record Control Section ARC

Figure 3:
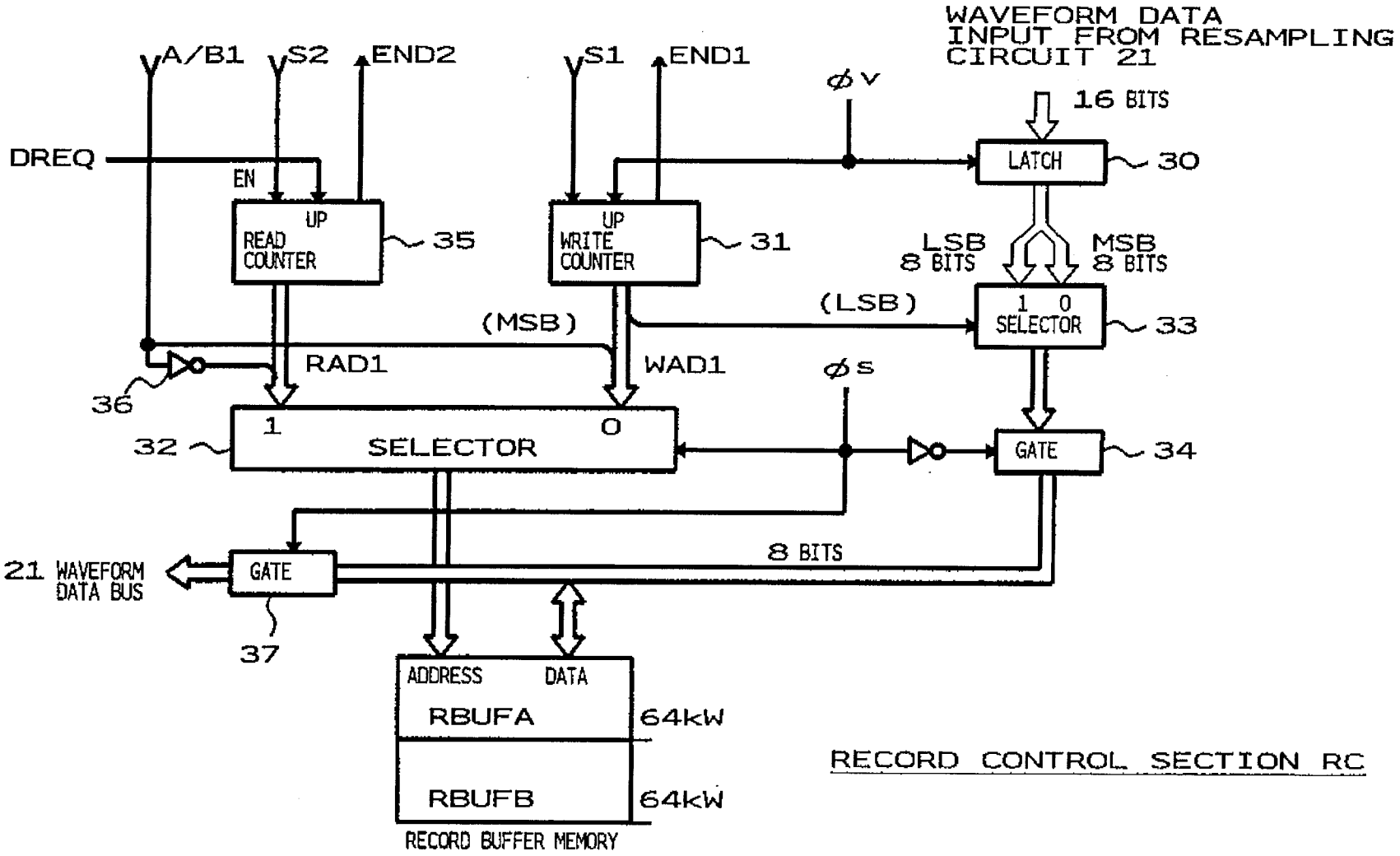
FIG. 3 is a functional block diagram illustrating an example of a record control section shown in FIG. 2.

FIG. 3 is a functional block diagram illustrating an example of the record control section ARC.

One sample of the digital sample data of waveform given from the resampling circuit 21 has 16 bits, which are input into a latch 30 in a parallel manner. This latch 30 latches the input data in accordance with the record sampling clock pulse $\phi_v$.

A write counter 31 generates a write address signal WAD1 for the record buffer memory RBUFA, RBUFB. When record is initiated and when write to the memory RBUFA, RBUF is initiated, this counter 31 is given from the microcomputer a start signal S1, in response to which it is enabled to start its counting action and increments the address signal WAD1 in accordance with the record sampling clock pulse $\phi_v$.

The microcomputer also gives the write counter 31 buffer instruction data A/B1 instructing which of the two record buffer memory sections RBUFA, RBUFB should be accessed, and this instruction data A/B1 is added as the uppermost or most significant bit of the write address signal WAD1 output from the counter 31. It is assumed here that when the buffer instruction data A/B1 is "0", the buffer memory section RBUFA is instructed or designated, and when the buffer instruction data A/B1 is "1", the buffer memory section RBUFB is designated.

The write address signal WAD1 is applied to the "0" input of a selector 32 so that it is selected when the system clock pulse $\phi_s$ is "0" and given to the address input of the record buffer memory RBUFA, RBUFB.

The system clock pulse $\phi_s$ is a high speed clock pulse and time-divisionally controls the write and readout to and from the buffer memory RBUFA, RBUFB. The write mode is established when the system clock pulse $\phi_s$ is "0", and the readout mode is established when the system clock pulse $\phi_s$ is "1". In a similar manner, the write and readout to and from the other buffer memories XBUFA, XBUFB, PBUFA, PBUFB are controlled on a high speed time divisional basis.

The 16-bit (=one word) parallel waveform sample data latched in the latch 30 is divided into the upper eight bits and lower eight bits so as to be applied to the "0" and "1" inputs of a selector 33, respectively. The lowermost or least significant bit signal LSB of the write address signal WAD1 is applied to the selection input of the selector 33 so as to select the upper eight bits or lower eight bits of the waveform sample data. A gate 34 is enabled when the system clock pulse $\phi_s$ is "0", i.e., during the write mode, so as to provide the data input of the record buffer memory RBUFA, RBUFB with the waveform data divided into eight-bit parallel form.

Each of the record buffer memory sections RBUFA, RBUFB is capable of storing eight-bit (one byte) data at each address and storing 64 kilowords as a whole.

Thus, the waveform data is written into one of the two record buffer memory sections in accordance with the write address signal WAD1 output from the write counter 31. The write counter 31 outputs an end signal END1 when it has counted up to the maximum count corresponding to the total number of addresses of one of the buffer memory sections RBUFA, RBUFB.

A read counter 35 serves to generate a read address signal RAD1 to read from the record buffer memory sections RBUFA, RBUFB. The microcomputer gives a start signal S2 to this read counter in response to generation of the end signal END1. The read counter 35 is enabled to start its counting action in response to the start signal S2 and increments the value of the read address signal RAD1 at a rapid speed in response to data request signal DREQ given from the SCSI interface 18. The above-mentioned buffer instruction data A/B1 is inverted by an inverter 36 and added as the most significant bit of the read address signal RAD1 output from the counter 35.

The read address signal RAD1 is applied to the "1" input of the selector 32 so that it is selected when the system clock pulse $\phi_s$ is "1" and applied to the address input of the record buffer memory RBUFA, RBUFB.

Accordingly, when one of the record buffer memory sections RBUFA, RBUFB is in the write mode, the other is in the read mode. For example, when write of the waveform data to one of the memory section RBUFA has been completed, the other memory section RBUFB is switched to the write mode to allow a next waveform data group to be written thereinto, and at the same time the one memory section RBUFA is switched to the read mode to allow the waveform data group written as mentioned to be read out therefrom. When the system clock pulse $\phi_s$ is "1", i.e., during the read mode, the waveform data read out from the record buffer memory are sent via a gate 37 to the waveform data bus 20, from which the data are sent through the SCSI interface 18 and SCSI bus PRB to the hard disk HD and written thereinto.

The read counter 35 outputs an end signal END2 when it has counted up to the maximum count corresponding to the total number of addresses of one of the buffer memory sections RBUFA, RBUFB. The end signal END2 and the above-mentioned end signal END1 of the write counter 31 are both given to the microcomputer as an interrupt signal.

In the example shown in FIG. 3, only one set of latch 30 and selector 33 are provided so that waveform data of only one channel can be written. However, waveform sample data of plural channels may be recorded, as waveform data of one data file, in an interleaved (alternately mixed ) manner. Although not specifically shown, arrangements for achieving that purpose may be such that components equivalent to the latch 30 and selector 33 are provided for each of the channels to be interleaved, waveform data sampled from the outside is input separately for each channel and then sampled in accordance with the sampling clock pulse $\phi_v$ and reformed into eight-bit data, and then the eight-bit waveform data of each channel is multiplexed and input to the buffer memory section RBUFA, RBUFB. In such a case, the multiplexing circuit may comprise means for properly buffer-storing the waveform data of each channel in such a manner that the waveform data of plural channels sampled in accordance with the sampling clock pulse $\phi_v$ are sequentially multiplexed in accordance with the same sampling clock pulse $\phi_v$ while being sequentially buffer-stored and then input to the buffer reproduction memory RBUFA, RBUFB.

Description on an Example of Recording Operation

The recording operation is controlled by an cooperation of the personal computer PC and the microcomputer of the record/reproduction control device RU. In the record control section RC of FIG. 3, preparation of the read and write signals RAD1, WAD1 and operation to read and write data are done in the above-described manner under the cooperative controls of the computers.

Figure 5:
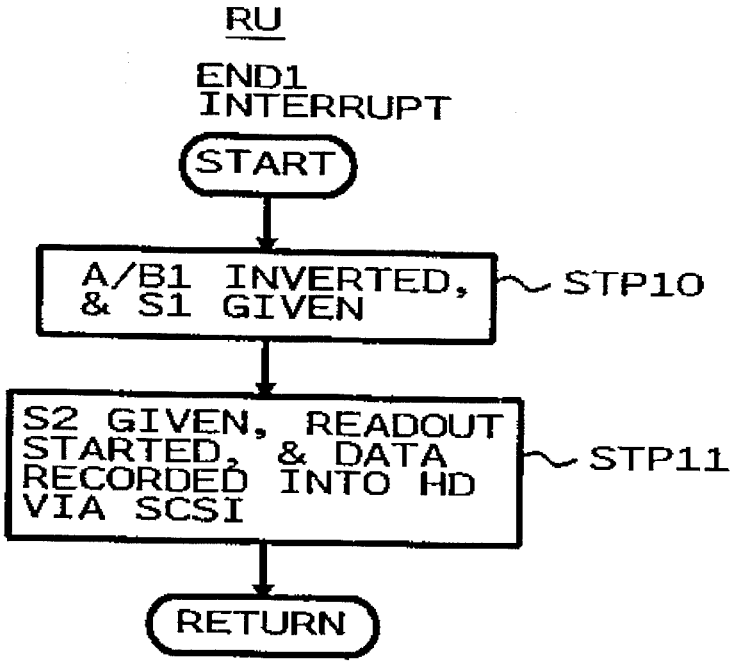
FIG. 5 is a flowchart illustrating an example of interrupt process carried out in the record/reproduction control device during the recording operation.
Figure 4:
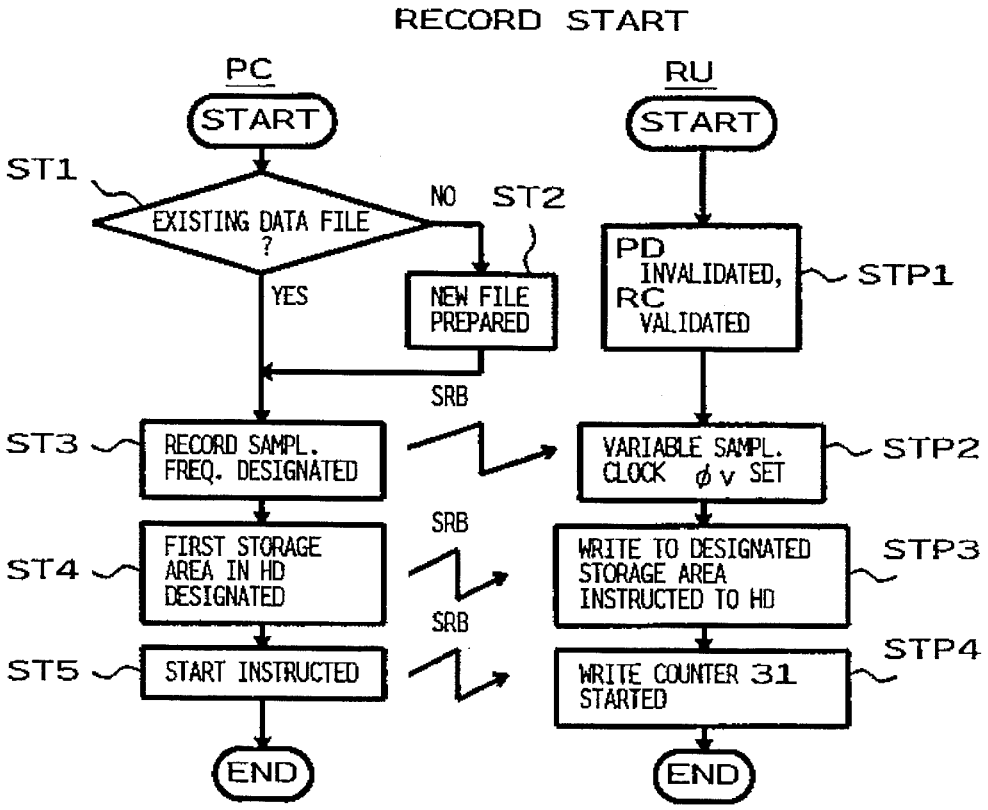
FIG. 4 is a flowchart illustrating an example of processes carried out by a personal computer and record/reproduction control device when a recording operation is initiated.
Figure 6:
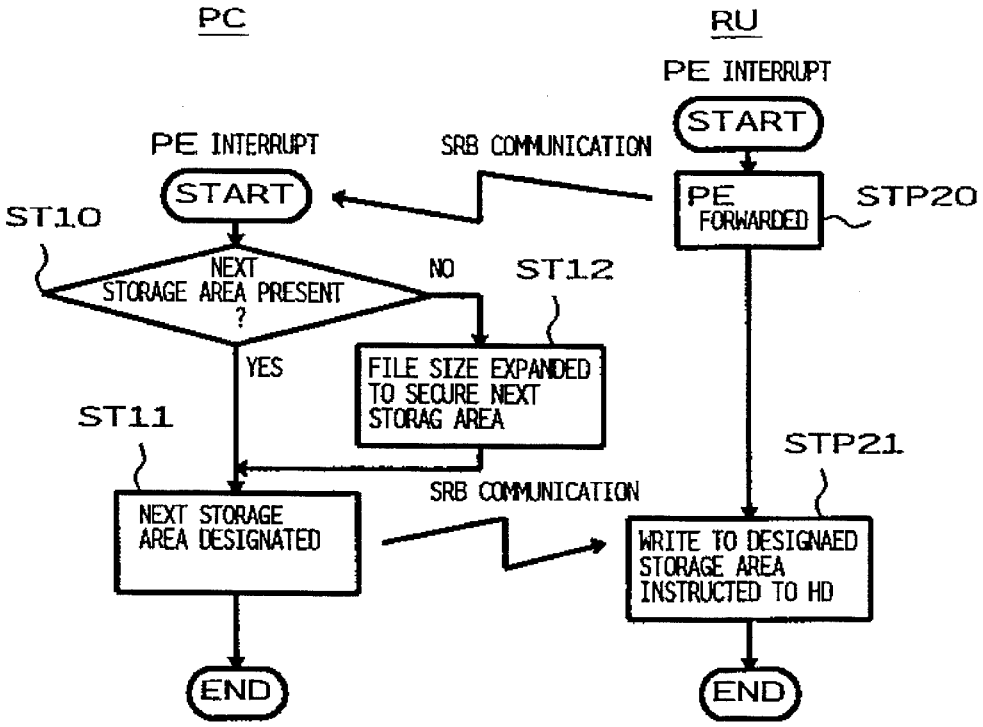
FIG. 6 is a flowchart illustrating an example of interrupt process for changing a recording area to which data write instruction should be given.

FIGS. 4 to 6 illustrate a general flow of the recording operation control performed by the cooperation of the personal computer PC and microcomputer of the record/reproduction control device RU. In the figures, the flow indicated by "PC" on the left is concerned with processes made by the personal computer PC, while the flow indicated by "RU" on the right is concerned with processes made by the record/reproduction control device RU.

In FIG. 4, there is shown a flow of processes performed when the recording operation is initiated. First, the personal computer PC specifies a data file to be recorded. If an additional record is to be made to an existing data file, such a process that allows an additional record to be made to a designated existing data file is performed in response to a corresponding input operation on the personal computer PC (step ST1).

Figure 7:
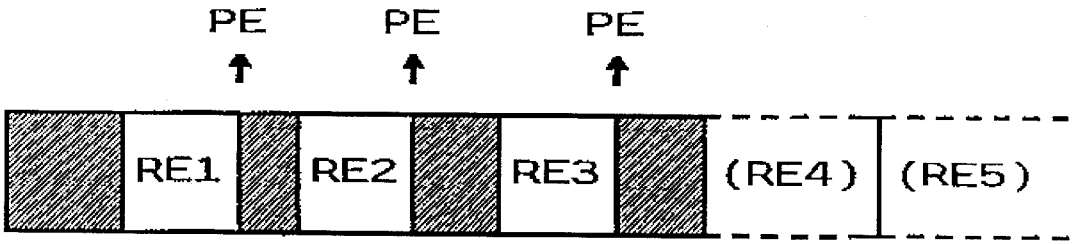
FIG. 7 is a diagram illustrating an example of data file recording area in a hard disk

If, on the other hand, a new data file is to be prepared, a new file preparation process is performed (step ST2). In this step ST2, entry of a desired file name and other necessary processes are performed. Also, the data file size is temporarily set to a predetermined size N, and storage areas corresponding to the predetermined size is reserved in the hard disk HD. An example of the storage areas thus reserved is shown in FIG. 7, in which three storage areas RE1, RE2, RE3 are reserved in the hard disk HD and the predetermined size is RE1+RE2+RE3=N.

On the other hand, the record/reproduction control device RU validates the operation of the record control section RC and invalidates the operation of the data transfer control section PD (step STP1).

Next, the personal computer PC designates a desired record sampling frequency (step ST3). This frequency designation data is given via the serial communication bus SRB to the record/reproduction control section RU where it is set to such a condition as to allow record sampling clock pulse $\phi_v$ of a desired frequency to be generated by the sampling clock pulse generation circuit 19 (step STP2).

Subsequently, the personal computer PC outputs data designating a storage area on which data record should first be made in the data file specified in the above-mentioned manner (step ST4). In the example of FIG. 7, for instance, data designating storage area RE1 is output from the personal computer PC. This storage area designating data is delivered via the serial communication bus SRB to the record/reproduction control device RU. On the basis of the storage area designating data, the record/reproduction control device RU acts as an initiator for the hard disk HD and instructs the hard disk HD to write to the designated storage area (step STP3). The hard disk HD receives this instruction as a target.

Next, the personal computer PC outputs an instruction to start the recording operation (step ST5). This recording operation start instruction is delivered via the serial communication bus SRB to the record/reproduction control section RU. On the basis of the start instruction, the record/reproduction control section RU gives a start signal S1 to the write counter 31 in the record control section RC (step STP4).

Once the start signal has been given to the write counter 31, the personal computer PC completes its recording process. In response to the start signal S1, the record control section RC initiates its own read/write controls as described above in conjunction with FIG. 3, and the above-mentioned process to record in the hard disk HD waveform data sampled from the outside is carried out under the control of the record control section RC. Accordingly, the personal computer PC is now freed from the operation to record data into the hard disk HD and therefore can engage in other necessary processes.

FIG. 5 shows an interrupt process which is carried out by the microcomputer when an end signal END1 has been output from the write counter 31 of the record control section RC during the recording operation. In this process, the value of buffer instruction data A/B1 is inverted to switch the record buffer memory section that should be placed in the write mode from one memory section (for example, RBUFA) to the other (foe example, RBUFB), and the start signal S1 is given to the write counter 31 so that count of the write address signal WAD1 is restarted from the initial value of "0" (step STP10). Then, the start signal S2 is given to the read counter 35 so that count of the read address signal RAD1 is started from the initial value of "0" (step STP11). Thus, a waveform data group in the record buffer memory section which have just finished a write action (for example, RBUFA) is read out and recorded into the hard disk HD.

FIG. 6 shows an interrupt process that is intended for switching the storage area of the hard disk HD on which data write should be done. First of all, the hard disk HD sequentially records, in the storage area designated in step STP3 of FIG. 4 (for example, RE1 of FIG. 7), the waveform data supplied via the SCSI bus PRB. When the designated storage area becomes full, a PE interrupt signal is generated and given via the SCSI bus PRB to the SCSI interface 18 (FIG. 18) of the record/reproduction device RU.

Upon receipt of the PE interrupt signal, the microcomputer of the record/reproduction device RU performs the interrupt process of FIG. 6 to forward this PE interrupt signal to the personal computer PC via the serial communication bus SRB (step STP20)

The personal computer PC checks whether or not there is a next storage area in the data file (ST10), and if the result is affirmative, it designates the next storage area (step ST11). In the example of FIG. 7, for instance, when the PE interrupt signal has been generated in correspondence to the storage area RE1, data designating the next storage area RE2 is output. This storage area designating data is given via the serial communication bus SRB to the record/reproduction control device RU. On the basis of the data, the control device RU instructs the hard disk HD to write to the designated storage area (step STP21).

If the result of step ST10 is negative, i.e., there is not a next storage area in the data file (in the example of FIG. 7, if the PE interrupt signal is generated in correspondence to the last storage area RE3), the personal computer PC performs a process for expanding the size of the data file (step ST12). That is, the personal computer PC performs a process for reserving additional storage areas RE4, RE5 . . . for this data file. In such a case, the added storage area RE4 is designated as the next storage area in step ST11. In this manner, one data file is progressively expanded until a record stop instruction is given, and it is therefore made possible to thoroughly record all tone waveform data having a great amount of data.

Description on Reproduction Mode

The present embodiment, when effecting reproductive tone generation with a predetermined tone generation channels (in the embodiment, four channels which are denoted by reference characters CH0, CH1, CH2 and CH3, respectively), can perform a reproduction process in two different reproduction modes. One is such a reproduction mode in which waveform data of plural data files can be simultaneously reproduced, and this mode will hereinafter be referred to as a segment reproduction mode. The other is such a reproduction mode in which waveform data of one data file is reproduced, and this mode will hereinafter be referred to as an interleave reproduction mode since it is suitable for reproducing a data file having waveform data of plural channels recorded in an interleaved state.

When simultaneously reproducing plural data files each having not-interleaved waveform data recorded therein, the segment reproduction mode makes it possible to simultaneously reproduce up to four data files. On the other hand, the interleave reproduction mode makes it possible to reproduce a data file having waveform data of as many as four channels recorded in an interleaved state. It can be selected as required in which of the reproduction modes the reproduction process should be performed.

Data file desired to be reproduced may be selected by any suitable means such as a keyboard operation on the personal computer PC, a panel switch operation on the record/reproduction control device RU, or entry of desired data file selecting data into the personal computer from the outside. Further, selection of the above-mentioned reproduction mode may be done in an interlocking relation to the selection of desired data file or may be done in response to an operation of a suitable mode selection switch.

When, for example, selection is made of reproduction of a desired data file which comprises tone data of plural channels recorded in an interleaved state, the interleave reproduction mode may be automatically selected.

Further, when selections is made of a desired file data which is not interleaved, the segment reproduction mode may be automatically selected. In this case, the operator may be informed by means of a display etc. that the segment reproduction mode has been selected and further data file can be selected to be reproduced if desired, in such a manner that the operator can be given a chance to select further data file.

Alternatively, a particular switch for selecting the segment reproduction mode may be provided so that selection of plural predetermined data files is permitted in the case where the segment reproduction mode is selected by this switch.

No matter which of the above-mentioned selection methods may be employed, ultimately the personal computer PC recognizes in which mode the desired reproduction should be performed, and segment data SEG indicative of the recognized reproduction mode and data designating record area of one or more data files to be reproduced are given to the record/reproduction control device RU via the serial communication bus SRB. Thus, the microcomputer of the record/reproduction control device RU accesses the hard disk HD via the SCSI interface 18 and SCSI bus PRB and instructs the hard disk HD to read out data from the designated storage area. The microcomputer further gives the segment data SEG to the transfer control section PD and instructs the control section PD in which mode the reproduction process should be done.

The interleave reproduction mode is instructed when the segment data, SEG is "0", and the segment reproduction mode (i.e., mode for simultaneously reproduction plural files) when the segment data SEG is "0".

Figure 8A:
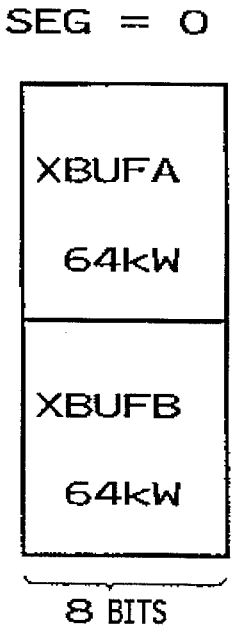
FIGS. 8A and 8B are diagram indicating that data write format varies depending on a reproduction mode selected.

Depending on which of the reproduction modes is designated, data are written into the fetch buffer memory sections XBUFA, XBUFB in different formats as shown in FIG. 8. The fetch buffer memory XBUFA, XBUFB has a total capacity of 128 kilowords, and when SEG=0, namely, when the selected reproduction mode is the interleave reproduction mode, it is used as two separate buffer memory sections or areas each having a capacity of 64 kilowords as shown in FIG. 8A. As previously mentioned, the suffix characters A and B represent a pair of buffer memory areas which allows read/write operation to be simultaneously performed while alternating the read/write modes between the two areas.

Figure 8B:
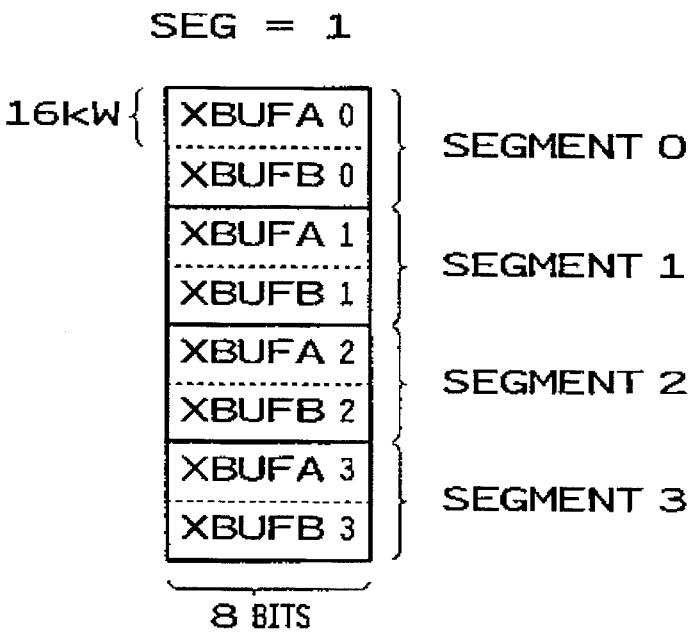

When SEG=1, namely, the selected mode is the segment reproduction mode, the fetch buffer memory XBUFA, XBUFB, as shown in FIG. 8B, is used as eight separate segment buffer memory sections or areas XBUFA0, XBUFB0, XBUFA1, XBUFB1, XBUFA2, XBUFB2, XBUFA3, XBUFB3 each having a capacity of 16 kilowords. The suffixes 0–3 represent different segments which correspond to four different data files. More specifically, data of four different data files are simultaneously read out from the hard disk HD in a parallel fashion (it may be apparent that, in practice, data of the four data files are read out with slight time lags). The read-out data of the four data files are fetched into the corresponding segments 0–3 in the buffer memory XBUFA, XBUFB (i.e., buffer XBUFA0 XBUFB3 of FIG. 8B). Again, the suffix characters A and B represent a pair of segment memory areas which allows read/write operation to be simultaneously performed while alternating the read/write modes. For example, two buffer memories XBUFA0, XBUFB0 constitute a pair which allows data of a given data file to be simultaneously read and write while alternating the read/write modes between the two areas.

Figure 9:
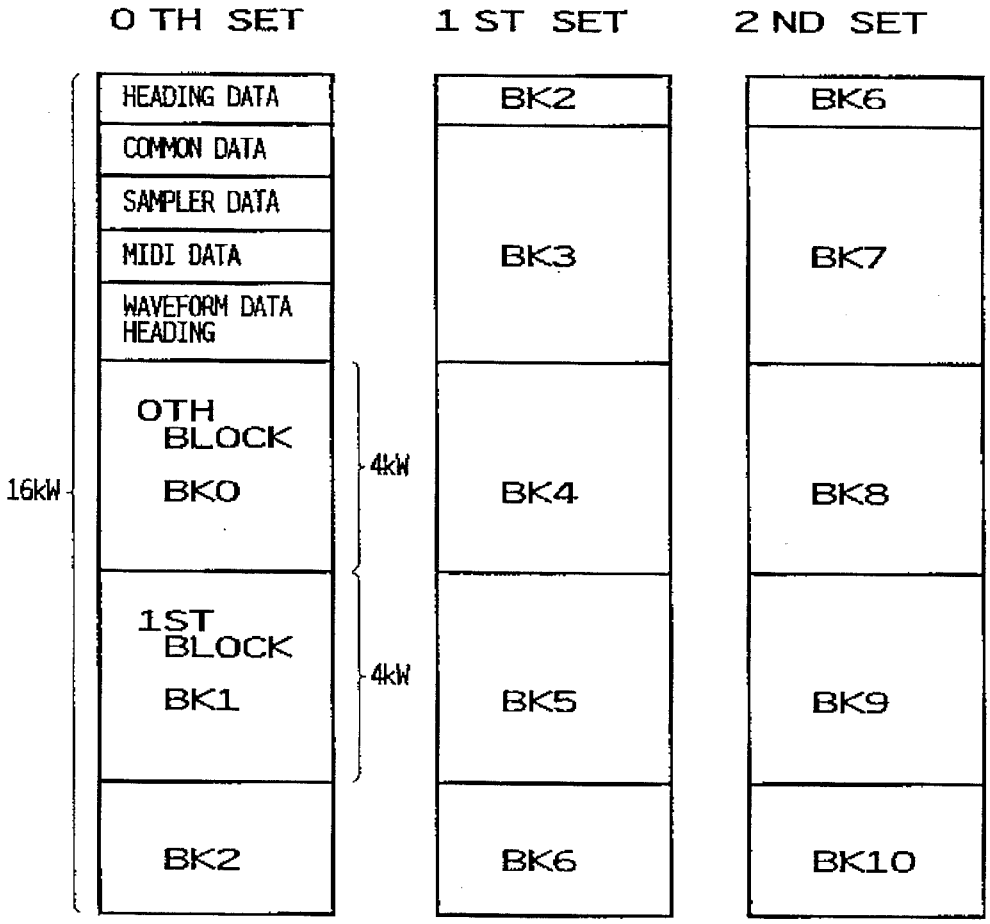
FIG. 9 is a diagram illustrating an example data format of a data file read out from the hard disk.

FIG. 9 illustrates an example data format of a certain data file that is read out from the hard disk HD when SEG=1, namely, the selected mode is the segment reproduction mode. Data sets each having 16 kilowords is read out from the hard disk HD.

In FIG. 9, the first 16 kiloword set (0th set) has a predetermined head area for storing heading data and various control data and an area that is provided next to the heading area for storing waveform data. Read/write of the waveform data is managed in predetermined data blocks each having four kilowords. Further, the size of the area for storing the heading data and various control data, and position of the first block of the waveform data are controlled by the personal computer PC. Since the size of each the blocks is four kilowords, positions of the second and following waveform data blocks can be calculated by the record/reproduction control section RU.

Since entire data read out from the hard disk HD are transferred and stored into the fetch buffer memory XBUFA, XBUFB (XBUFA0 XBUFB3), heading data and other various control data are also fetched, but data other than the waveform data are controlled not to be transferred to the reproduction buffer memory PBUFA, PBUFB. The heading data and other control data are passed through the fetch buffer memory XBUFA, XBUFB into the microcomputer where they are utilized for controlling the reproduction operation as the occasion may demand. Alternatively, the heading data and other control data may be read by the personal computer PC.

For example, data of the second block BK2 are separated between the 0th and first sets, and therefore they are separately fetched into the first-level fetch buffer memory XBUFA0–XBUFB3; however, as described later, transfer control is made such that one block of data are stored together into the second-level reproduction buffer memory PBUFA, PBUFB.

When SEG=0, namely, the selected mode is the interleave reproduction mode, readout format of a data file may be composed of sets each having 16 kilowords similar to that of FIG. 9. But, because each of the fetch buffer memory sections XBUFA, XBUFB has a capacity of 64 kilowords, it can take in four sets=64 kilowords as well as one set=16 kilowords. Further, because it is assumed that data block size is four kilowords for one channel, it is also assumed here that, in the case of the data recorded in an interleaved state, read/write control is performed with the number of interleaved channels×four kilowords being treated as one data block. For example, in the case of two-channel interleave, eight kilowords are controlled as one data block. Moreover, in order that one set of fetched data may contain data of four blocks at the maximum, the number of interleaved channels×16 kilowords may be fetched, as one set data during the interleave reproduction mode, into the fetch buffer memory XBUFA, XBUFB.

Figure 10:
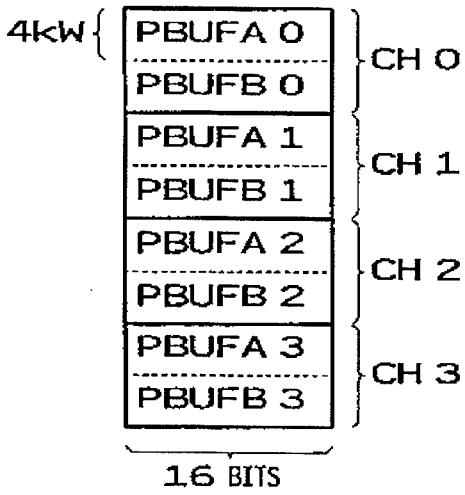
FIG. 10 is a diagram illustrating data recording areas in a reproduction buffer memory which store individual data blocks corresponding to plural channels.

FIG. 10 shows a data format of the reproduction buffer memory PBUFA, PBUFB which is composed of eight memory areas PBUFA0, PBUFB0, PBUFA1, PBUFB1, PBUFA2, PBUFB2, PBUFA3, PBUFB3. The numerical suffixes 0–3 correspond to tone generation channels CH0–CH3. Again, the suffixes A and B represent a pair of memory areas which allows data of a given data file to be simultaneously read and write while alternating the read/write modes between the two areas. Accordingly, for each channel, waveform data of four kilowords=one block can be written and read simultaneously.

Into the areas PBUFA0, PBUFB0, PBUFA1, PBUFB1, PBUFA2, PBUFB2, PBUFA3, PBUFB3 corresponding to the channels CH0–CH3, waveform data assigned to the respective channels are stored. Namely, waveform data of the respective channels released from the interleaved state are stored in a distributed fashion during the interleave reproduction mode, and waveform data of the respective segments (namely, respective data files) are stored in a distributed fashion during the segment reproduction mode, as will be described later. Therefore, as will be described later, the reproduced sound generation section TG only needs to read out the tone data stored in the individual channel areas of the reproduction buffer memory PBUFA, PBUFB and does not need to perform different read controls for the two reproduction modes, which achieves very simple arrangements. With simple arrangements, it is made possible to perform a reproduction process that is properly adapted to or deals with the two different modes.

Description on the Reproduction/Transfer Control Section PD

Figure 11:
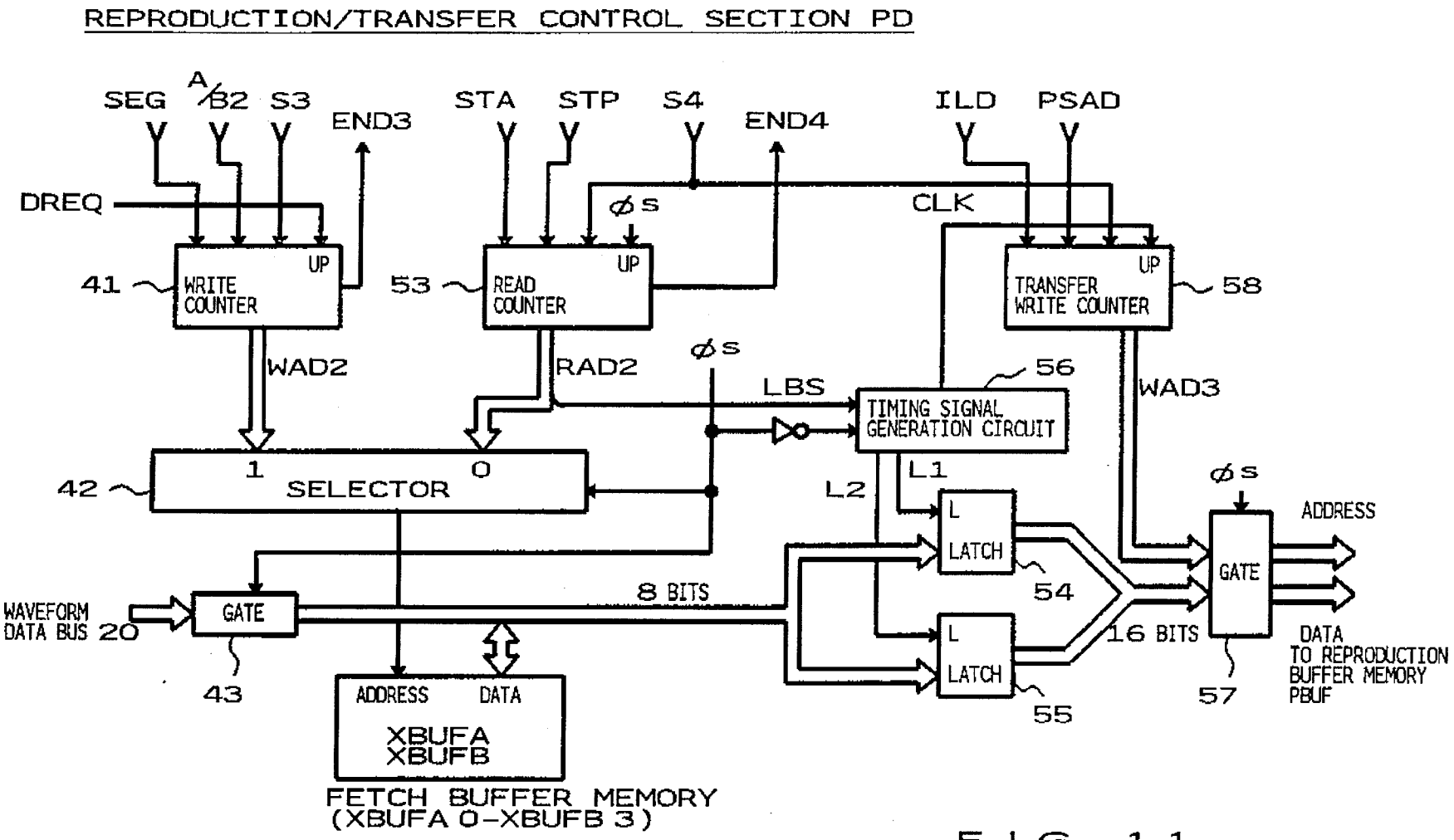
FIG. 11 is a functional block diagram illustrating an example structure of a reproduction/transfer control section shown in FIG. 2.

FIG. 11 is a functional block diagram showing an example of the reproduction/transfer control section PD.

A write counter 41 serves to generate a write address signal WAD2 for writing to the fetch buffer memory XBUFA, XBUFB. When a reproduction preparation switch is turned on or when other predetermined conditions are satisfied, this write counter 41 is given a start signal S3 by the microcomputer, so that it is enabled to start its counting action and then increments value of the write address signal WAD at a high speed in response to a data request signal DREQ supplied from the SCSI interface 18. In this case, the data request signal DREQ is supplied when data is read out from the hard disk HD, that is, when it is requested that data read out from the hard disk HD be fetched into the fetch buffer memory XBUFA, XBUFB.

In addition, there are given by the microcomputer buffer instructing data A/B2 that instructs which of the paired fetch buffer memory areas XBUFA, XBUFB should be accessed and the above-mentioned segment data SEG designating one of the reproduction modes.

The write address signal WAD2 output from the write counter 41 is applied to the "1" input of the selector 42, so that it is selected and given to the address input of the fetch buffer memory XBUFA, XBUFB when the system clock $\phi_s$ is "1".

Data read out from the hard disk HD are delivered to the data input of the fetch buffer memory XBUFA, XBUFB by way of the SCSI bus PRB, SCSI interface 18, waveform data bus 20 and gate 43. When the system clock $\phi_s$ is "1", namely, when the fetch buffer memory is in the write mode, the gate 43 is enabled to pass the data read out from the hard disk HD onto the fetch buffer memory XBUFA, XBUFB.

Now, an example of the write counter 41 will be described in more detail with reference to FIG. 12.

Figure 12:
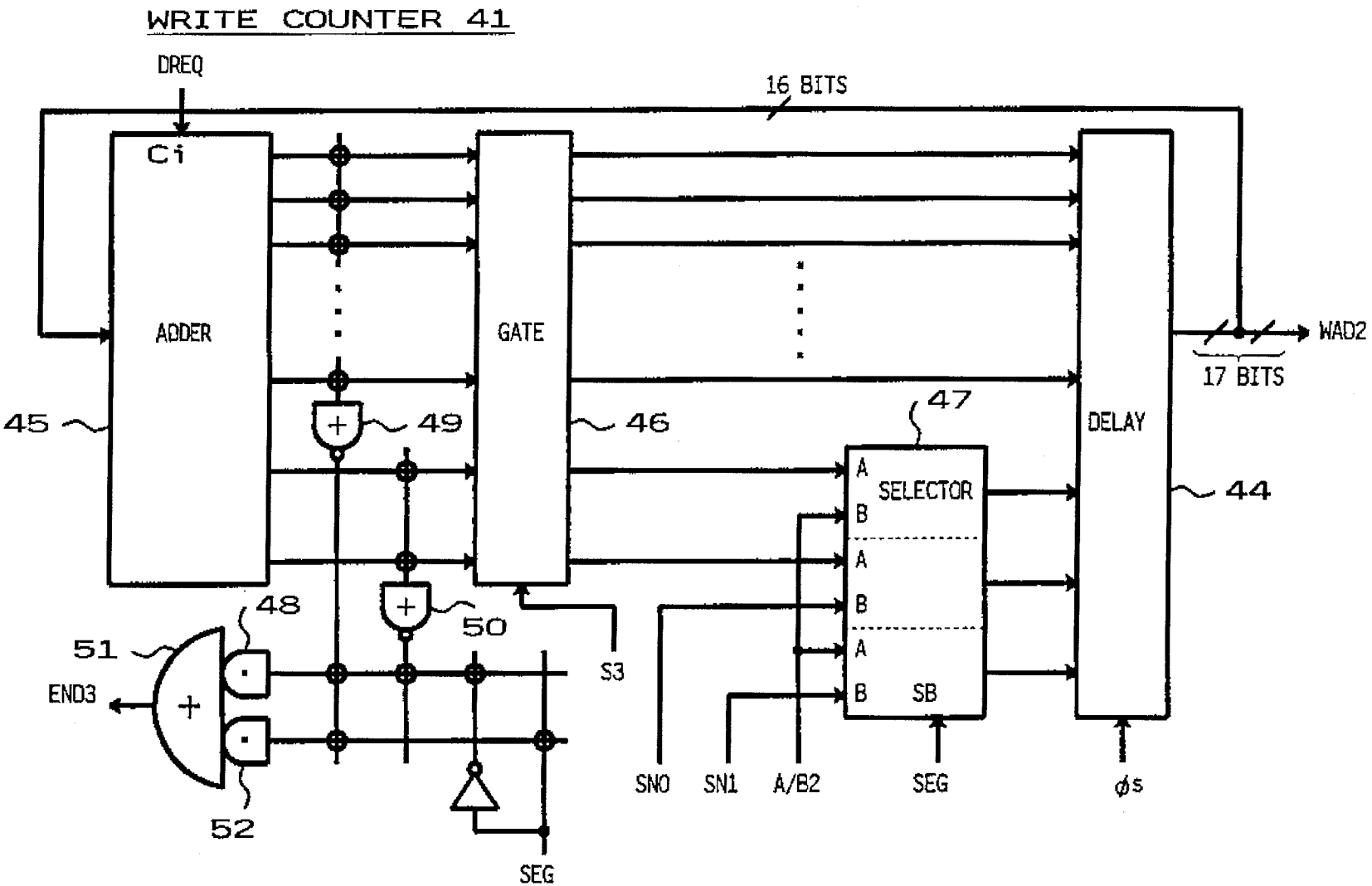
FIG. 12 is a functional block diagram illustrating details of a write counter shown in FIG. 11.

In FIG. 12, counting circuitry is composed of a 17-parallel-bit circuit 44 which achieves a one-bit time delay in response to the system clock $\phi_s$, an adder 45 which inputs thereto lower 16-bit parallel output from the delay circuit 44 and inputs the data request signal DREQ to its lowermost carry-in input Ci, and a gate 46 which is enabled by the start signal S3 to pass an output of the adder 45 to the delay circuit 44. 17-bit output of the delay circuit 44 is provided as the write address signal WAD2.

A selector 47 selectively controls the upper three bit data of the write address signal WAD2 depending on the reproduction mode selected, in such a manner that, when the segment data SEG=0, namely, in the interleave reproduction mode, the buffer instructing data A/B2 is used as the most significant bit of the write address signal WAD2 and count value is used as the lower 16 bits. In this way, write address signal WAD2 can be generated which variably designates, in accordance with the buffer instructing data A/B2, one of the fetch buffer memory sections XBUFA, XBUFB divided as two 64-kiloword sections in a format as shown in FIG. 8A and further designates addresses of 64 kilowords in one of the fetch buffer memory sections XBUFA, XBUFB. Further, when SEG=0, an AND gate 48 is enabled, and NOR gates 49, 50 output "1" once all of 16 bit count outputs of the adder 45 become "0", and output of the AND gate 48 becomes "1", in response to which end signal END3 is generated from an OR gate 51. In other word, the end signal END3 is generated when write addresses for 64 kilowords have been counted.

When, on the other hand, value of the segment data SEG=1, namely, in the segment reproduction mode, the selector 47 selects segment number designating bits SN0, SN1 as the uppermost two bits of the write address signal WAD2 and selects the buffer instructing data A/B2 as the third uppermost bit data. And, counted value is used as the remaining lower 14 bits of the write signal WAD2. The segment number designating bits SN0, SN1, which constitute data that designates one of the above-mentioned segments 0–3, are given by the microcomputer along with the segment data SEG. Value of the segment number designating bits SN0, SN1 corresponds to a data file being read out from the hard disk HD.

In this way, write address signal WAD2 can be generated which designates, by the segment number designating bits SN0, SN1, one of the memory section pairs corresponding to one segment 0–3, from among eight segment buffer memory sections XBUFA0, XBUFB0, XBUFA1, XBUFB1, XBUFA2, XBUFB2, XBUFA3, XBUFB3 each divided as a 16 kiloword section in a format as shown in FIG. 8B, and which variably designates one of the paired memory sections in accordance with the buffer instructing data A/B2, and which further designates, by the 14-bit counted value, addresses for 16 kilowords in the designated 16 kiloword memory section XBUFA0–XBUFB3. When SEG=1, an AND gate 52 is enabled, and NOR gates 49 output "1" once all of lower 14-bit count outputs of the adder 45 become "0", and thereby output of the AND gate 52 becomes "1", in response to which end signal END3 is generated from the OR gate 51. In other word, the end signal END3 is generated when write addresses for 16 kilowords have been counted.

In response to the end signal END3 generated from the write counter 41 in the above-described manner, the microcomputer changes the values of the buffer instructing data A/B2 and segment number designating bits SN0, SN1. Namely, in the case of the interleave reproduction mode (SEG=0), the microcomputer inverts the value of the buffer instructing data A/B2 in response to the end signal END3. In the case of the segment reproduction mode (SEG=1), the values of the segment number designating bits SN1, SN0 are changed in the order of 00, 01, 10 and 11 so that the number of segment to be accessed is changed in the order of 0, 1, 2 and 3. Then, the microcomputer inverts the value of the buffer instructing data A/B2 in response to generation of every fourth end signal END3. Thus, in the segment reproduction mode (SEG=1), the fetch segment buffer memory sections are sequentially switched to the write mode in the order of XBUFA0→XBUFB1→XBUFA2→XBUFA3→XBUFB0→XBUFB1→XBUFB2→XBUFB3.

Now referring back to FIG. 11, a read counter 53 serves to generates read address signal RAD2 for reading from the fetch buffer memory XBUFA, XBUFB. More specifically, when one block of data stored in the fetch buffer memory XBUFA, XBUFB is to be transferred and stored into the reproduction buffer memory PBUFA, PBUFB, this read counter 53 is given a start signal S4 by the microcomputer so that it is enabled to start its counting action to thereby generate read address signal RAD2 in accordance with the system clock pulse $\phi_s$. At this time, count start address and count stop address are designated by start address data STA and stop address data STP supplied from the microcomputer, and the read address signal RAD2 is generated between the start and stop addresses.

The read address signal RAD2 is applied to the "0" input of the selector 42 so that it is selected when the system clock pulse $\phi_s$ is "0" and then delivered to the address input of the fetch buffer address XBUFA, XBUFB. Thus, the read/write mode of the fetch buffer memory XBUFA, XBUFB is time-divisionally controlled in accordance with "0" and "1" of the system clock pulse $\phi_s$.

Read control of the fetch buffer memory XBUFA, XBUFB by the read counter 53 is performed with a view to transferring and storing waveform data that are stored in the fetch buffer memory XBUFA, XBUFB, into the reproduction buffer memory PBUFA, PBUFB in blocks (each block having four kilowords). Therefore, the start and stop address data STA, STP together designate one block (four kilowords) of waveform data to be transferred to the fetch buffer memory PBUFA, PBUFB.

It should be understood that, if one block of data to be transferred is stored, as a whole, in the fetch buffer memory XBUFA, XBUFB, start and stop addresses of the block are designated as the start and stop address data STA, STP, respectively. If, however, one block of data is fetched into the fetch buffer memory XBUFA, XBUFB in a divided manner like the second block BK2 in the format shown in FIG. 9, then the first half of the block data is read out by designating the block start address with start address data STA and designating the address of division point with stop address data STP, and the second half is read out by designating the address of division point with start address data STA and designating the block end address with atop address data STP. In this way, one block comprising the divided data can be properly read out from the fetch buffer memory XBUFA, XBUFB in a divided manner on two successive occasions and can finally be stored into the reproduction buffer memory PBUFA, PBUFB in an undivided form.

Eight-bit waveform data read out from the fetch buffer memory XBUFA, XBUFB is input to latches 54 and 55. A timing signal generation circuit 56 receives the least significant bit LSB of the read address signal RAD2 so that it generates latch pulses L1, L2 for the latches 54, 55 in response to "1" and "0" of the signal LSB and in synchronism with "0" of the system clock pulse $\phi_s$. Thus, when upper eight-bit data of the 16-bit waveform sample data are read out from the buffer memory XBUFA, XBUFB, the latch pulse L1 is generated so that the upper eight-bit data are latched into the latch 54, and when lower eight-bit data of the 16-bit waveform sample data are read out from the buffer memory XBUFA, XBUFB, the latch pulse L2 is generated so that the lower eight-bit data is latched into the latch 55. In this way, the 16-bit waveform sample data can be combined or rearranged into parallel data on the output side of the latches 54, 55.

This 16-bit waveform sample data are applied to the data input of the reproduction buffer memory PBUFA, PBUFB via a gate 57. The gate 57 is enabled in synchronism with "1" of the system clock pulse $\phi_s$. When the system clock pulse $\phi_s$ is "1", the reproduction buffer memory PBUFA, PBUFB is brought into the write mode.

A transfer write counter 58 serves to prepare a transfer write signal WAD3 for the reproduction buffer memory PBUFA, PBUFB. When one block of the data stored in the fetch buffer memory XBUFA, XBUFB is to be transferred to the reproduction buffer memory PBUFA, PBUFB, the transfer write counter 58 is given a start signal S4 by the microcomputer so that the counter 58 is enabled to start it counting action and generates the transfer write address signal WAD3. Count clock pulse CLK is generated from the timing signal generation circuit 56 in response to the least significant bit LSB of the read address signal RAD2 and is controlled in such a manner that the transfer write address signal WAD3 is incremented by one address per two addresses of the read address signal RAD2. This is because data readout from the fetch buffer memory XBUFA, XBUFB is done in a eight-bit parallel fashion, while the data write to the reproduction buffer memory PBUFA, PBUFB is done in a 16-bit parallel fashion.

In the case of the interleave reproduction mode, interleave data ILD to cancel the interleaved state is given from the microcomputer to the transfer write counter 58. The interleave data ILD instructs tone generation channels to which waveform data of plural channels interleaved in a file should be assigned; it instructs tone generation channels CH0 and CH3 when, for example, waveform data interleaved for two channels are to be assigned to channels CH0 and CH3. The transfer write counter 58 prepares the transfer write address signal WAD3 so as to sequentially designate channels indicated by the interleave data ILD. Thus, when, for example, interleaved waveform sample data of the first channel is read out from the buffer memory XBUFA, XBUFB, controls can be made such that transfer write address signal WAD3 designating channel CH0 is generated from the transfer write counter 58 when interleaved waveform sample data corresponding to channel CH0 is read out from the buffer memory XBUFA, XBUFB, and then this waveform sample data is assigned to and stored into one of the reproduction buffer memory areas PBUFA0, PBUFB0 which correspond to channel CH0. Further, controls can be made such that transfer write address signal WAD3 designating channel CH3 is generated from the transfer write counter 58 when interleaved waveform sample data of the second channel is read out from the buffer memory XBUFA, XBUFB as the next readout sample data, and then this waveform sample data is assigned to and stored into one of the reproduction buffer memory areas PBUFA3, PBUFB3 which correspond to channel 3. At that time, start address data PSAD is given from the microcomputer to the transfer write counter 58 in order to instruct which one of the reproduction buffer memory areas corresponding to each of the channels should first be written to.

In the case of the segment reproduction mode, data designating tone generation channels CH0–CH3 corresponding to the segments 0–3 is given, as interleave data ILD, from the microcomputer to the transfer written counter 58. In this case, the interleave data ILD indicates channel corresponding to any of the segments 0–3 (namely, data files) contained in the segment reproduction mode. If, for example, two data files assigned to segments 0 and 1 are to be simultaneously reproduced, two channels CH0, CH1 corresponding to segments 0 and 1 are indicated as the interleave data ILD. It should be noted that, since readout from the buffer memory XBUFA0–XBUFB3 is time-divisionally performed for each segment, four kilowords at a time, only interleave data ILD of a channel corresponding to a segment being currently read out becomes "1". Thus, through a similar process to that in the above-mentioned interleave cancellation, waveform data of one segment (data file) of which four-kiloword data is being read out is assigned to the corresponding channel and stored into the corresponding channel area (PBUFA0–PBUFB3 of FIG. 10) of the reproduction buffer memory PBUFA, PBUFB.

Next, a specific example of the transfer write counter 58 will be described with reference to FIG. 13.

Figure 13:
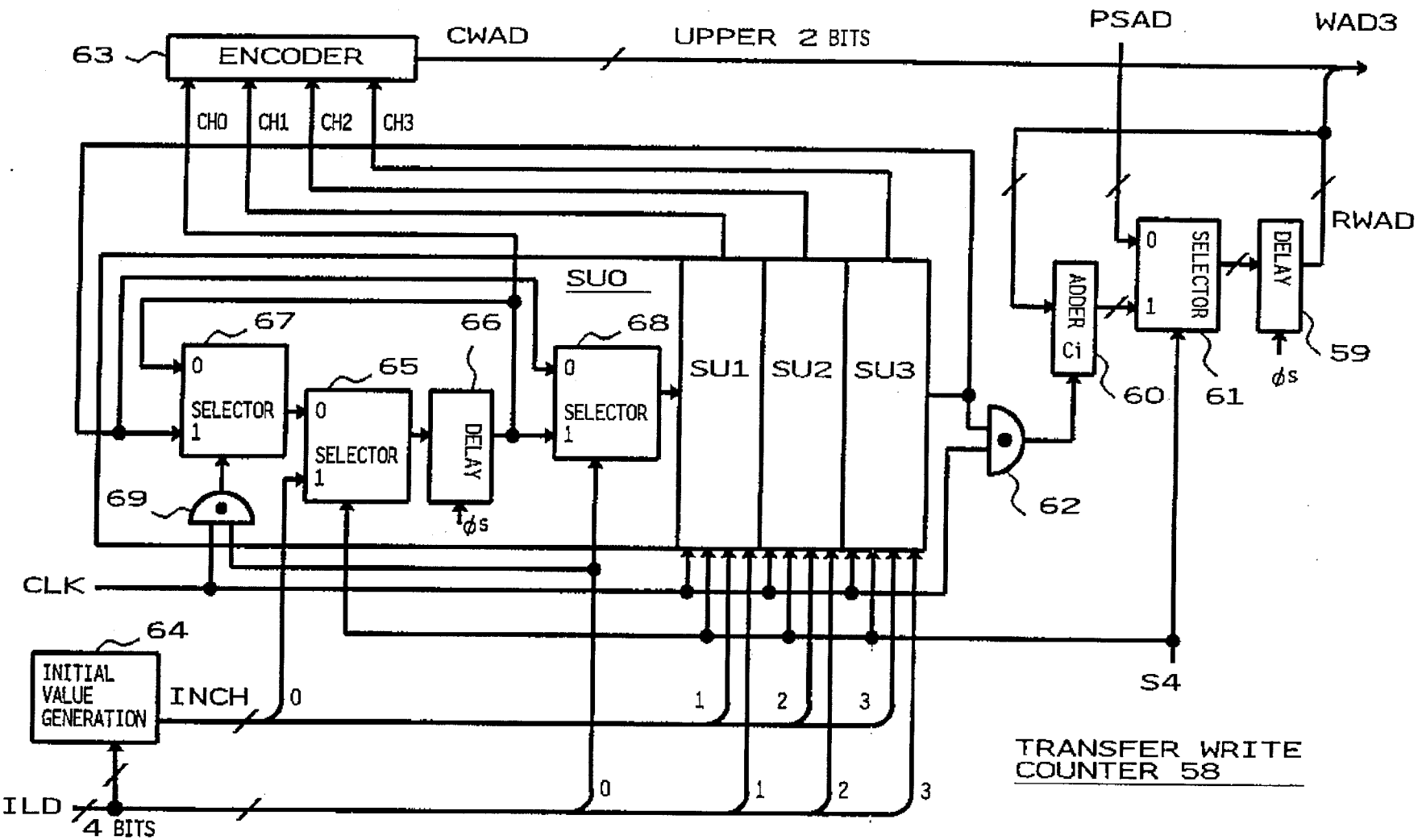
FIG. 13 is a functional block diagram illustrating details of a transfer write counter shown in FIG. 11.

In FIG. 13, a loop which is composed of a delay circuit 59 for achieving a one-bit time delay in accordance with the system clock pulse $\phi_s$, an adder 60 for adding output of an AND gate 62 to output data of the delay circuit 59 and a selector 61 serves to generate relative address signal RWAD that designates relative address in the memory areas of the reproduction buffer memory PBUFA, PBUFB for each channel (4 kW+4 kW=8 kiloword memory area). First, at the rising edge of start signal S4, start address data PSAD is selected in the selector 61 so that address count is started using the start address data PSAD as an initial value. This start address data PSAD is data instructing with which one of the paired reproduction buffer memory sections (A, B) corresponding to one channel a write operation should start. Thereafter, the count value of the relative address signal RWAD increases each time a count-up signal is given from the AND gate 62.

Two-bit channel address signal CWAD is generated from an encoder 63 to be added to the uppermost bit of the relative address signal RWAD, and thereby the transfer write address signal WAD3 is obtained. From the channel address signal CWAD, it is possible to identify a channel CH0–CH3 to which a write operation in the reproduction buffer memory PBUFA, PBUFB is instructed.

An initial value generation circuit 64 generates initial value data INCH indicating a channel to which a write operation should be instructed first, in accordance with the interleave data ILD. Relations between the interleave data ILD and the initial value data INCH are shown by way of example in the table below. It is to be noted that each of the interleave data ILD and initial value data INCH is a four-bit data and numbers 0–3 represent respective bit numbers which correspond to channels CH0–CH3. In the interleave data ILD, any bits that corresponds to interleaved channels CH0–CH3 to which waveform data of interleaved channels should be assigned (or in the case of the segment reproduction mode, channels CH0–CH3 to which waveform data of the segments to be simultaneously reproduced should be assigned) becomes "1".

TABLE 1

| ILD | | | | INCH | | | | Change in CWAD | | | | | (→ |
|---|---|---|---|---|---|---|---|---|---|---|---|---|---|
| 0 | 1 | 2 | 3 | 0 | 1 | 2 | 3 | t0 | t1 | t2 | t3 | t4 | Time) |
| 0 | 0 | 0 | 0 | 0 | 0 | 0 | 0 | 0 | 0 | 0 | 0 | 0 | ... |
| 0 | 0 | 0 | 1 | 0 | 0 | 0 | 1 | 3 | 3 | 3 | 3 | 3 | ... |
| 0 | 0 | 1 | 0 | 0 | 0 | 1 | 0 | 2 | 2 | 2 | 2 | 2 | ... |
| 0 | 0 | 1 | 1 | 0 | 0 | 1 | 0 | 2 | 3 | 2 | 3 | 2 | ... |
| 0 | 1 | 0 | 0 | 0 | 1 | 0 | 0 | 1 | 1 | 1 | 1 | 1 | ... |
| 0 | 1 | 0 | 1 | 0 | 1 | 0 | 0 | 1 | 3 | 1 | 3 | 1 | ... |
| 0 | 1 | 1 | 0 | 0 | 1 | 0 | 0 | 1 | 2 | 1 | 2 | 1 | ... |
| 0 | 1 | 1 | 1 | 0 | 1 | 0 | 0 | 1 | 2 | 3 | 1 | 2 | ... |

TABLE 1-continued

| ILD | | | | INCH | | | | Change in CWAD | | | | | (→ |
|---|---|---|---|---|---|---|---|---|---|---|---|---|---|
| 0 | 1 | 2 | 3 | 0 | 1 | 2 | 3 | t0 | t1 | t2 | t3 | t4 | Time) |
| 1 | 0 | 0 | 0 | 1 | 0 | 0 | 0 | 0 | 0 | 0 | 0 | 0 | ... |
| 1 | 0 | 0 | 1 | 1 | 0 | 0 | 0 | 0 | 3 | 0 | 3 | 0 | ... |
| 1 | 0 | 1 | 0 | 1 | 0 | 0 | 0 | 0 | 2 | 0 | 2 | 0 | ... |
| 1 | 0 | 1 | 1 | 1 | 0 | 0 | 0 | 0 | 2 | 3 | 0 | 2 | ... |
| 1 | 1 | 0 | 0 | 1 | 0 | 0 | 0 | 0 | 1 | 0 | 1 | 0 | ... |
| 1 | 1 | 0 | 1 | 1 | 0 | 0 | 0 | 0 | 1 | 3 | 0 | 1 | ... |
| 1 | 1 | 1 | 0 | 1 | 0 | 0 | 0 | 0 | 1 | 2 | 0 | 1 | ... |
| 1 | 1 | 1 | 1 | 1 | 0 | 0 | 0 | 0 | 1 | 2 | 3 | 0 | ... |

As may be understood from the table, even if the intrleave data ILD has "1" s for plural bits (channels), the initial value data INCH shows "1" only for predetermined one bit (channel) of those bits which are "1" in the interleave data ILD.

Each bit 0–3 in the interleave data ILD and the initial value data INCH is input to a shift unit SU0–SU3 corresponding to the channel CH0–CH3. Although the inner structure of only one shift unit SU0 is shown, it should be appreciated that the other shift units are of the same structure.

In the shift unit SU0, a selector 65 selects the initial value data INCH via the "1" input in synchronism with the rising edge of the start signal S4, and the selected data INCH is input to a delay circuit 66, in which the data is delayed a one bit time by the system clock pulse $\phi_s$. Delayed of the delay output circuit 66 is fed back to the "0" input of an input selector 67 and also applied to the "1" input of an output selector 68. Output signal of the input selector 68 is given to the next-stage shift unit SU1 where it is input to the "1" input of an input selector 67. In a similar manner, to the "1" input of the selector 67 of the shift unit SU0 is applied an output signal of the preceding-stage shift unit SU3. The output signal of the preceding-stage selector SU3 is also given to the "0" input of the output selector 68. In this manner, the shift units SU0–SU3 are ring-connected. The interleave data ILD corresponding to the channel is given as a selection signal to the output selector 68. Further, output of an AND gate 69 through which count clock pulse CLK and the interleave data ILD are ANDed is given as a selection signal to the input signal 67. When the count clock pulse CLK is not present, the input selector 67 selects the output of the delay circuit 66 applied to the "0" input and gives it to the "0" input of selector 65. The selector 65 selects the initial value data INCH at the "1" input only at the rising time of the start signal S4, and at other times than this it selects the "0" input.

In the above-mentioned ring-connected shift units SU0–SU3, first, a single signal "1" of the initial value data INCH is received into a shift unit SU0–SU3 corresponding thereto. The received signal "1" is circulated through the delay circuit 66, "0" input of the selector 67 and "0" input of the selector 65 and is retained in the shift unit. Once the count clock pulse CLK becomes "1", the input selector 67 selects the "1" input so that the circulation of the signal "1" in the shift unit is cancelled. The signal "1" is provided to a next-stage shift unit via the "1" input of the selector 68. At this time, if the interleave data ILD corresponding to the next channel is "0", the input selector 67 of the next-stage shift unit selects its "0" input and the output selector 68 also selects its "0" input, and so the provided signal "1" is not introduced into the shift unit stage but is immediately passed onto a further next shift unit via the "0" input of the output selector 68.

If, on the other hand, the interleave data ILD corresponding to a shift unit to which the signal "1" is applied is "1", the input selector 67 selects its "1" input when the count clock pulse becomes "1", so that the signal "1" provided from a preceding shift unit is introduced into the shift unit. Further, because the output selector 68 selects its "1" input, the signal "1" applied to its "0" is not passed onto a next shift unit stage. The signal "1" introduced through the input selector 67 is delayed a one-bit time by the delay circuit 66 and then is circulated in a loop of the circuits 65, 66, 67.

In the foregoing manner, the single signal "1" introduced into one of the shift units SU0–SU3 in correspondence to "1" of the initial value data INCH is shifted, in response to generation of the count clock pulse, to a shift unit SU0–SU3 that corresponds to a channel of which the interleave data ILD is "1". Namely, the single signal "1" in the loop of the shift units SU0–SU3 passes over or jumps a shift unit SU0–SU3 that corresponds to a channel of which the interleave data is "0".

Outputs from the respective delay circuits 66 of the shift units SU0–SU3 are input to the encoder 63. Only one of the four inputs of the encoder 63 which corresponds to one shift unit SU0–SU3 in which the single signal "1" is retained becomes "1". The encoder 63 encodes a channel code corresponding to the input signal "1" and outputs the encoded result as channel address signal CWAD. In the foregoing table 1, there is also shown an example of time-varying states of the channel address signal CWAD generated in correspondence to various conditions of the interleave data ILD. In the table 1, times t0, t1, t2 . . . correspond to generation timings of the count clock pulse CLK.

The output signal of the last shift unit SU3 in the shift unit loop is applied to the AND gate 62 so that an AND of this signal and the count clock pulse CLK is applied as a count pulse signal to the adder 60. Thus, when the high-order channel address signal CWAD has completed one circulation, the low-order address signal RWAD is counted up by one. Namely, in the case of the interleave reproduction mode, during the time in which the relative address signal RWAD designates a relative address of a 8 kiloword (4 kW+4 kW) area in the reproduction buffer areas PBUFA0, PBUFB0, PBUFA1, PBUFB1, PBUFA2, PBUFB2, PBUFA3, PBUFB3 of each channel CH0–CH3, the high-order channel address signal CWAD sequentially changes in correspondence to the interleaved channels designated by the interleave data ILD, so that a specific write address is instructed by a write address signal WAD3 which comprises a combination of these signals. Then, when the value of the channel address signal CWAD has made a round of changes in correspondence to necessary channels, the value of the relative address signal RWAD increases by one.

Similarly, in the case of the segment reproduction mode, the interleave data ILD designates a specific channel in correspondence to a segment being currently read out, and the high-order channel address signal CWAD takes a value corresponding to the channel. And, a specific write address is instructed by a write address signal WAD3 which comprises a combination of the high-order channel address signal CWAD and the low-order relative address signal RWAD.

Description on the Reproduced Sound Generation Section TG

Figure 14:
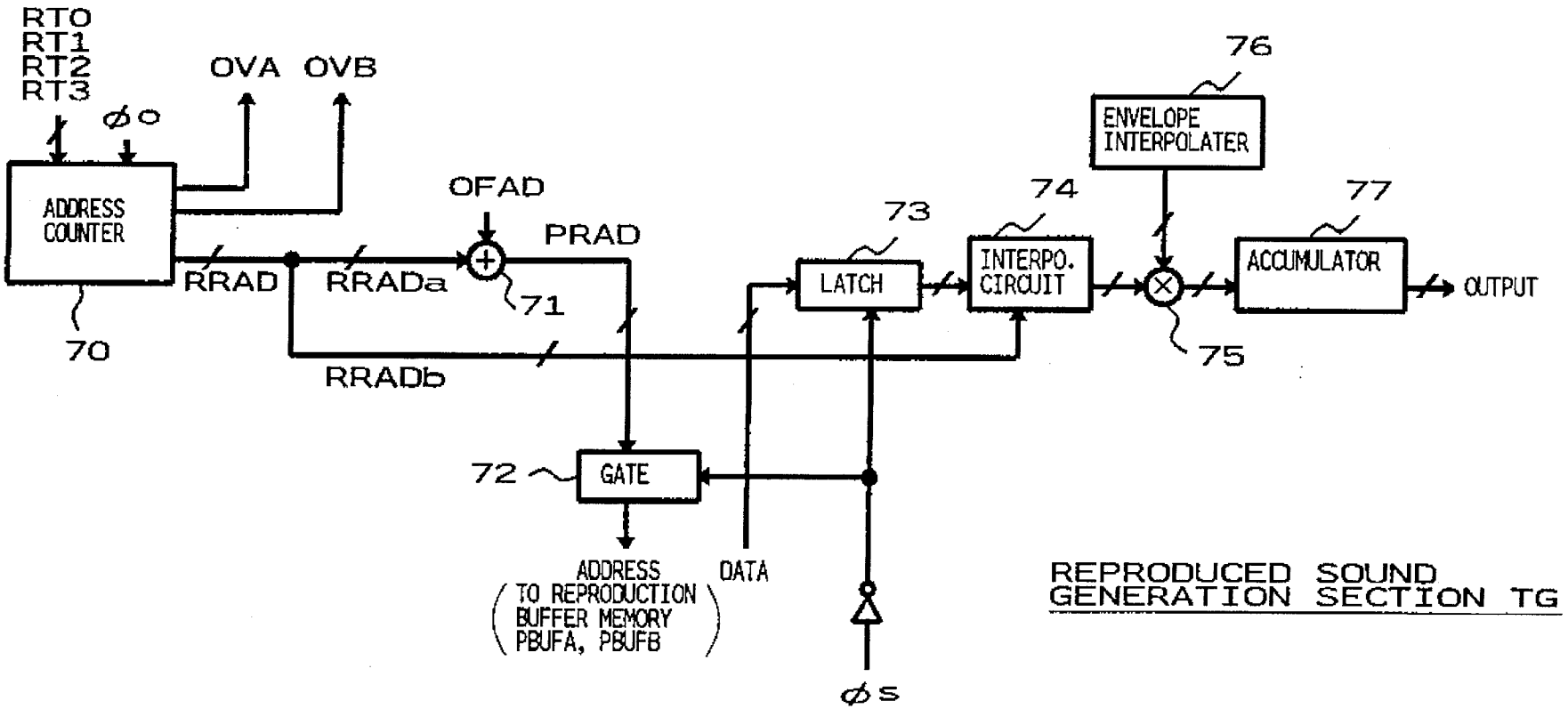
FIG. 14 is a functional block diagram illustrating an example of a reproduced sound generation section shown in FIG. 2.

FIG. 14 shows a specific example of the reproduced sound generation section TG.

Readout rate data RT0, RT1, RT2, RT3 for the individual channels are given from the microcomputer to an address counter 70. For each of the channels, the address counter 70 accumulates the readout rate data RT0, RT1, RT2, RT3 at a sampling time interval according to the predetermined reproduction sampling clock pulse $\phi_o$ so as to generate relative address signal RRAD to be used for retroductive readout. As previously mentioned, the readout rate data RT0, RT1, RT2, RT3 is determined fundamentally by a ratio between the record sampling frequency and the predetermined reproduction sampling frequency and also by a ratio between the pitch of recorded original sound and a desired pitch of reproduced sound. The record sampling frequency for recording waveform data is common to all the channels in the case of the interleave reproduction mode, but, in the case of the segment reproduction mode, the record sampling frequency for data files (channels) to be simultaneously reproduced may be different from each other. Namely, because the readout rate data RT0, RT1, RT2, RT3 for each channel is, as mentioned, determined by a ratio between the record sampling frequency and the predetermined reproduction sampling frequency and also by a ratio between the pitch of recorded original sound and a desired pitch of reproduced sound, it is allowed to simultaneously reproduce plural sounds recorded with different record sampling frequencies, in accordance with a common reproduction sampling frequency. Although not described in details, reset control signal and other necessary control signals are given from the microcomputer to the address counter 70.

The readout rate data RT0, RT1, RT2, RT3 is a value containing a decimal fraction part, and the relative address signal RRAD used for reproductive readout also has an integer part RRADa and a decimal fraction part RRADb. In addition, the microcomputer provides this reproduced sound section TG with offset address data OFAD that instructs, for each channel, from which of the paired reproduction memory areas (PBUFA0, PBUFB0; PBUFA1, PBUFB1; PBUFA2, PBUFB2; PBUFA3, PBUFB3) data should be read out. An adder 71 adds the integer part RRADa of the relative address signal RRAD of each channel with the offset address data OFAD and outputs the addition results as reproductive read address signals PRAD indicating, in absolute form, read addresses in the reproduction buffer memory PBUFA, PBUFB. The reproductive read address signals PRAD are passed through a gate 72 when the system clock pulse is "0" and are applied to the address input of the reproduction buffer memory PBUFA, PBUFB. Since, as previously mentioned, the reproduction buffer memory PBUFA, PBUFB is constructed to be brought to the write mode when the system clock pulse is "1", the reproductive read address signal PRAD is supplied when the system clock pulse is "0" to thereby place the buffer memory PBUFA, PBUFB in the read mode.

Waveform data read out from the reproduction buffer memory PBUFA, PBUFB in response to the reproductive read address PRAD for each channel are latched into a latch 73. On the basis of the waveform data latched into the latch 73, an interpolation circuit 74 performs waveform sample interpolation operations in accordance with the decimal fraction part RRADb of the relative address signal RRAD. Output signal of the interpolation circuit 74 is applied to a multiplier 75 in which it is multiplied by envelope waveform signal supplied from an envelope interpolator 76. Envelope-imparted waveform data of plural channels thus provided from the multiplier 75 are added together by an accumulator 77 so that one sample data of digital waveform which is a sum of sample data of plural channels is obtained. The envelope interpolator 76 receives envelope waveform target value data and interpolation rate data from the microcomputer, and it, on the basis of the received data, carries out an envelope waveform forming interpolation operation for each channel to thereby generate an envelope waveform signal for each channel.

When the read relative address signal RRAD of a certain channel has changed enough for one block, the address counter 70 generates overflow signal OVA, OVB as interrupt signal, in response to which the microcomputer switches the offset address data OFAD of the channel to designate the other of the paired reproduction memory sections of the channel. Further, in order that a next block of the waveform data may be transferred and stored into the reproduction buffer memory section having finished a read operation, the microcomputer switches the start address data STA and stop address data STP to be given to the read counter 53 of the reproduction/transfer control section PD so that the data STA and STP designate another block to be read out next, and the microcomputer also switches the start address data PSAD to be given to the transfer write counter 58 so that the data PSAD designates the other reproduction buffer memory section for which a write operation should be done next.

Instructions on the reproductive tone generation may be given by means of any suitable manual operations, such as operation of the reproduction selection switch, key depression operation on the keyboard, or entry of note-on data based on the MIDI (Musical Instrument Digital Interface). Moreover, in the interleave reproduction mode or in the segment reproduction mode, it is not always necessary to cause the waveform data of all channels (all segments) to be sounded exactly at the same time (in synchronism), but the data may be sounded with suitable time lags or only data of desired channel may be selectively sounded.

Description on an Example of Reproduction Operation

Control of the reproduction operation is performed by the cooperation of the personal computer and the record/reproduction control device RU in a similar manner to the record operation. Under such a cooperative control, the reproduction/reproduction control device RU carries out preparation of the read/write address signals RAD2, WAD2, WAD3 and data read/write processes in the above-mentioned manner.

Figure 15:
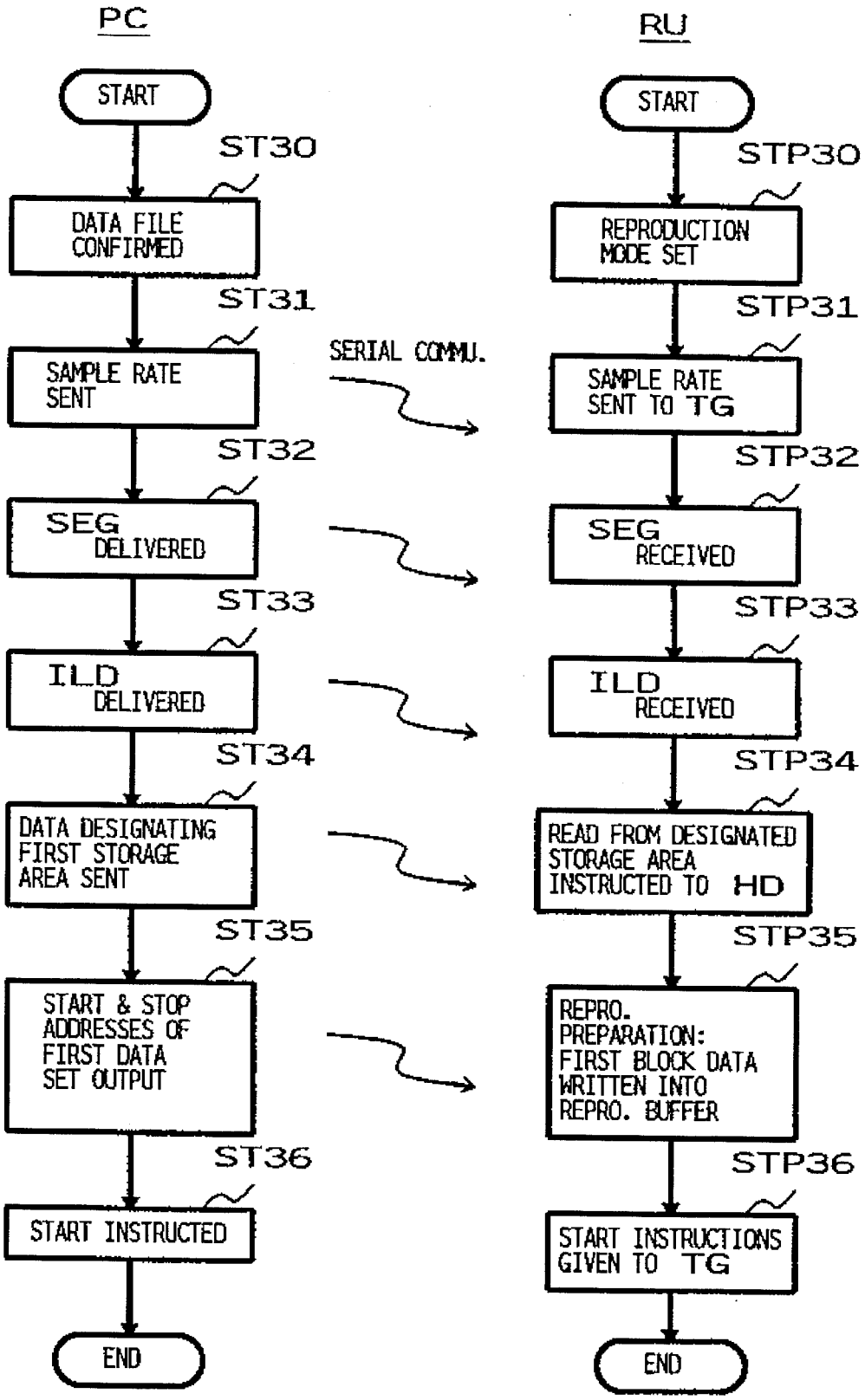
FIG. 15 is a flowchart illustrating an example of processes performed by the personal computer and record/reproduction control device when a reproduction operation is initiated.

FIG. 15 illustrates a general flow of processes performed at the beginning of the reproduction operation by the cooperation between the personal computer PC and the record/reproduction control device RU.

First, the personal computer PC confirms data file that should be reproduced (step ST30). In this step, the personal computer PC directly reads out from the hard disk HD such data other than waveform data, namely, heading data and various control data of the data file that is selected to be reproduced.

On the other hand, the record/reproduction control device RU performs a process for setting the operation mode to the reproduction mode, invalidates the operation of the record control section RC and validates the operation of the reproduction/data transfer control section PD (step STP30).

Next, the personal computer PC takes, out of the read-out heading data and various control data, sample rate data indicative of a record sampling frequency for the data file and sends the sample rate data to the record/reproduction control device RU via the serial communication bus SRB (step ST31).

Then, the record/reproduction control device RU prepares reproductive readout rate data RT0–RT3 in accordance with the sample rate data received via the serial communication bus SRB and applies the prepared data to the reproduced sound generation section TG (step STP31).

Next, on the basis of the heading data and various control data, the personal computer PC delivers the segment data SEG and interleave data ILD depending upon presence or absence of interleave in the data file (steps ST32 and ST33). The record/reproduction control device RU receives these data SEG and ILD through the serial communication bus SRB and passes the received data SEG and ILD to the reproduction/transfer control section PD (steps STP32 and STP33).

Subsequently, the personal computer PC sends out data designating a recording area (for example, RE1 of FIG. 7) on which reproduction should first be done (step ST34). This storage area designating data is given to the record/reproduction control device RU via the serial communication bus SRB. In response to this, the control device RU acts as an initiator for the hard disk HD connected thereto via the SCSI bus and instructs the hard disk HD to read from the designated storage area (step STP34).

Then, the personal computer PC outputs data that instructs start and stop addresses of a first four-kiloword waveform data block BK0 in a data set to be first fetched into the fetch buffer memory XBUFA, XBUFB (for example, 0th data of FIG. 9) (step ST35). The record/reproduction control device RU receives this address instructing data through the serial communication bus SRB and provides start address data STA and stop address data STP of a block to be first read out from the buffer memory XBUFA, XBUFB. Next, the control device RU reads out the first block data ranging between the start and stop address data STA and ST1D from the buffer memory XBUFA, XBUFB and writes the block data into the reproduction buffer memory PBUFA, PBUFB (step STP35).

Next, the personal computer PC instructs a start of the reproduction operation (step ST36). On the basis of the instructions, the record/reproduction control device RU instructs the address counter 70 of the reproduced sound generation section TG to start its address generation operation and also instructs the envelope interpolator 76 to start its envelope waveform generation operation (step STP36).

Once the personal computer PC gives the reproduction start instructions, it finishes its reproduction process. Thereafter, as mentioned earlier in connection with FIG. 11, the reproduction/transfer control section PD performs its read/write control and data transfer operations in an independent manner, and the reproduced sound generation section TG performs its own reproductive read controls. In consequence, the personal computer PC can be freed from works of reading data from the hard disk HD and therefore can carry out other processes as required.

The personal computer PC may employ any suitable channel assignment method to determine channels to which waveform data transferred from the hard disk HD are to be assigned, and it may then generate the interleave data ILD in accordance with the thus determined channels.

An exemplary channel assignment method may be such that any of the tone generation channels CH0–CH3 that is not in use is searched for and interleave data ILD is generated in correspondence with the unused channel thus searched for so that the waveform data transferred from the hard disk HD is assigned to the channel. If, in this case, there is not the necessary number of unused channels, this process may be made in accordance with a given suitable rule. For example, the waveform data transfer from the hard disk HD may be cancelled as an error, or a predetermined truncating process may be carried out such that relatively old assignment to channel being currently used is compulsorily cancelled to secure a channel for a new assignment.

Another channel assignment method may be such that, when entering a reproduction command, the player also designates which file should be assigned to which channel, so that the interleave data ILD is generated in accordance with such a channel designation.

Still another channel assignment method may be such that channel assignment instruction data is also included in heading data of each file so that the interleave data ILD is generated in accordance with such instruction data.

Example of Interleave of Waveform Sample Data

Figure 16:
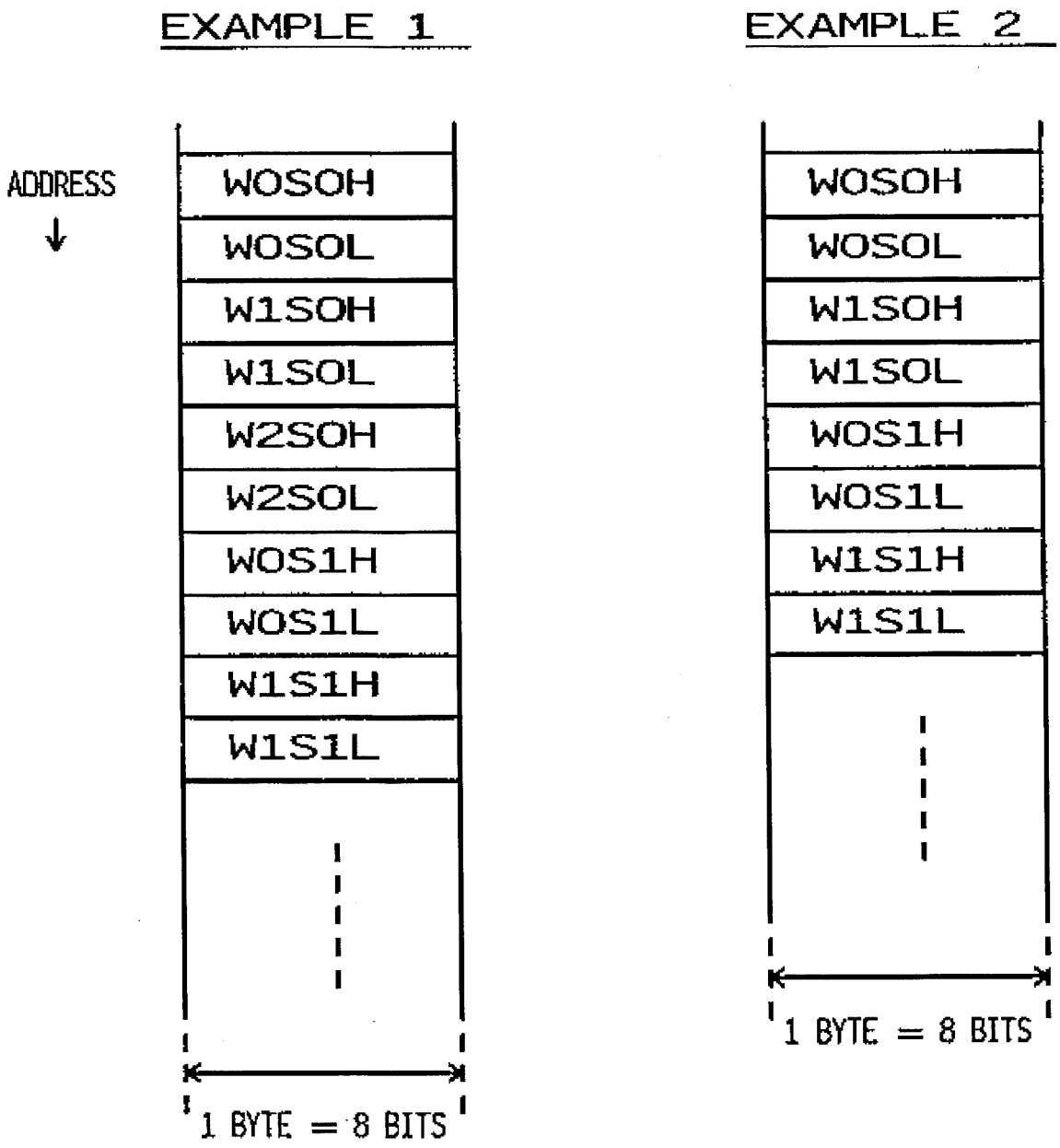
FIG. 16 illustrates a manner in which waveform sample data of plural channels are stored within a data file in an interleaved state.

FIG. 16 illustrates examples of interleave of waveform sample data fetched from the hard disk HD to the fetch buffer memory XBUFA, XBUFB. Example 1 in this figure exemplifies a three-channel interleave, and Example 2 exemplifies a two-channel interleave, in which WOSOH represents upper eight bits of waveform data in sample 0 (SOH) of channel 0 (W0), and WOSOL represents lower eight bits of waveform data in sample 0 (SOL) of channel 0 (W0). W1 represents channel 1, W2 represents channel 2, S1H represents upper eight bits of waveform data of sample 1, and S1L represents lower eight bits of waveform data in sample 1. As may be understood from the Examples, in the interleaved state, waveform sample data of different channels appear once for every two words.

Description on an Example of Interleaved Data Reproduction Operation

For fuller understanding of the interleave reproduction, further description will be made below on a case where a two-channel-interleaved data file is reproduced. If only one data file is reproduced, the segment data SEG is made "0" and the interleave reproduction mode becomes effective. In this case, the fetch buffer memory XBUFA, XBUFB, as shown in FIG. 8A, is divided into two memory sections as denoted by suffixes A and B. Although each of the memory sections has a storage capacity of 64 kilowords, it is assumed here that only one data set=16 kilowords is stored in each memory section.

Because one block of waveform data for one channel is four kilowords, one block in a two-channel-interleaved state has a total data size of eight kilowords. It is also assumed that data transfer from the hard disk HD to the fetch buffer memory XBUFA, XBUFB is performed data set (=16 kilowords) by data set, and time required for the data transfer is 62 ms.

First, 16 kilowords of the 0th set are fetched into one buffer memory section XBUFA, and then 16 kilowords of the first set are fetched into the other buffer memory section XBUFB. Thereafter, as mentioned previously, data transfer to the reproduction buffer memory is done. Once all the waveform data in the one buffer memory section XBUFA are transferred to the reproduction buffer memory PBUFA, PBUFB, 16 kilowords of the following second set are fetched into the one buffer memory section XBUF. Similarly, once all the waveform data in the other buffer memory section XBUFB are transferred to the reproduction buffer memory PBUFA, PBUFB, 16 kilowords of the third set are fetched into the buffer memory section XBUFB. In this manner, the 16-kiloword data sets in the hard disk HD are transferred to the two fetch buffer memory sections XBUFA, XBUFB in an alternating manner.

As previously mentioned, the data transfer from the fetch buffer memory XBUFA, XBUFB is performed block by block, i.e., four kilowords at a time, while the interleave is being cancelled. First, data of the first waveform data block BK0, namely, 2 channels×4 kilowords=8 kilowords are read out from sequential addresses of the buffer memory section XBUFA designated under the control of the above-mentioned read counter 53 (FIG. 11), and at the same time the read-out data are distributively written into sequential addresses of the reproduction buffer memory areas PBUFA0–PBUFA3 corresponding a channel designated by the interleave data ILD under the control of the transfer write counter 58 (FIGS. 11 and 13). If, at this time, the data of the first block BK0 are divided between the 0th and first sets, the remaining data of the block BK0 are read out from the other fetch buffer memory section XBUFB and transferred to the reproduction buffer memory PBUFA0–PBUFA3.

As previously mentioned, the interleave data ILD takes a value "1" in connection with plural tone generation channels to which waveform data of interleaved channels are to be assigned. If, for example, the waveform data are assigned to channels CH0 and CH2, then the waveform data of the interleaved first channel are transferred to the reproduction buffer memory area PBUFA0 corresponding to the channel CH0 and the waveform data of the second channel are transferred to the reproduction buffer memory area PBUFA2 corresponding to the channel CH2. The data transfer from the fetch buffer memory XBUFA, XBUFB to the reproduction buffer memory PBUFA, PBUFB is performed at a very rapid speed, for example, 2.6 ms per four kilowords. Subsequently, four kilowords of the following block BK1 are transferred to the B-group reproduction buffer memory areas PBUFB0, PBUFB2 for storage thereinto.

When the waveform data of the first and next blocks BK0, BK1 have been transferred to the reproduction buffer memory sections PBUFA, PBUFB corresponding to the tone generation channels to which the waveform data of interleaved channels are assigned, the device is brought into the standby state. In this standby state, actuation of the reproduction start switch by the player starts a process for reading from the reproduction buffer memory areas of the A and B groups PBUFA0–PBUFB3 through the reproduced sound generation section TG (FIG. 14), and thus reproductive tone generation from the waveform data is initiated.

First, reproductive readout from the A-group reproduction buffer memory areas PBUFA0–PBUFA3 is done, and then reproductive readout from the B-group reproduction buffer areas PBUFB0–PBUFB3 is done. To any of the buffer memory areas for which data readout has been finished, four kiloword data of a next block are transferred from the fetch buffer memory XBUFA, XBUFB in the above-mentioned manner.

Thus, readout from the A-group buffer memory areas PBUFA0–PBUFA3 and from the B-group buffer memory areas PBUFA0–PBUFB3 are performed in an alternating fashion.

Description on an Example of the Segment Reproduction Operation

For better understanding of the segment reproduction, further description will now be made of a case where four data files are reproduced simultaneously. As mentioned earlier, when plural data files are reproduced simultaneously, the segment data SEG is set to "1", namely, the segment reproduction mode is made effective. As shown in FIG. 8B, the fetch buffer memory XBUFA, XBUFB is divided into two memory areas A and B for each segment 0–3 (in total, eight memory areas XBUFA0–XBUFB3). In this case, each memory area has a capacity of 16 kilowords and can store one data set=16 kiloword data. Data transfer from the hard disk HD to the fetch buffer memory XBUFA0–XBUFB3 is done data set by data set, in a similar manner to the above-mentioned.

First, 16 kiloword data of the 0th set of each data file are fetched into the corresponding buffer memory area XBUFA0–XBUFA3. Then, 16 kiloword data of the first set of each data file are fetched into the corresponding buffer memory area XBUFB0–XBUFB3. Thereafter, in a manner similar to the above-mentioned, 16 kiloword data are fetched from the hard disk HD in an alternating fashion each time the data are transferred to the reproduction buffer memory PBUFA, PBUFB.

The data transfer from the fetch buffer memory XBUFA0–XBUFB3 is performed on a time divisional basis for each segment, one block=four kilowords at a time.

When the 16 kiloword data of the 0th set have been fetched into the A-group buffer memory area XBUFA0 for segment 0, four kiloword data of the first waveform data block BK0 are sequentially read out from the memory area XBUFA0 under the control of the above-mentioned read counter 53 (FIG. 11), and at the same time the read-out data are, under the control of the transfer and write counter 58 (FIGS. 11 and 13), assigned to an A-group reproduction buffer memory area PBUFA0 corresponding to an assignment channel designated by the interleave data ILD (for example, channel CH0) and stored into sequential addresses of the memory area PBUFA0. This data transfer is completed in no time, requiring only 2.6 ms. Thereafter, four kiloword data of the following waveform data block BK1 are sequentially read out from the memory area XBUFA0, and the read-out data are assigned to an B-group reproduction buffer memory area PBUFB0 corresponding to an assignment channel CH0 designated by the interleave data ILD and stored into sequential addresses of the memory area PBUFB0.

When the 16 kiloword data of the 0th set have been fetched into the A-group buffer memory area XBUFA1 for segment 1, four kiloword data of the blocks BK0 and BK1 are, in a manner to the above-mentioned, sequentially read out from the memory area XBUFA1, and the read-out waveform data are transferred to an A-group reproduction buffer memory area corresponding to an assignment channel designated by the interleave data ILD (for example, channel CH1) for storage therein.

The other segments 2 and 3 are processed in a similar manner.

When the waveform data of the first and second blocks BK0 and BK1 of the individual data file have been transferred to the respective A and B reproduction buffer memory areas PBUFA0 PBUFB3 corresponding to the tone generation channels CH0–CH3 to which the data files (segments 0–3) are assigned, the device is brought into the standby state. In this standby state, actuation of the reproduction start switch by the player starts a process for reading from the reproduction buffer memory areas of the A and B groups PBUFA0–PBUFB3 through the reproduced sound generation section TG (FIG. 14), and thus simultanenous reproductive tone generation from the waveform data of the plural data files is initiated.

In a manner similar to the above-mentioned, reproductive readout from the A-group reproduction buffer memory areas PBUFA0–PBUFA3 is done, and then reproductive readout from the B-group reproduction buffer areas PBUFB0–PBUFB3 is done. To any of the buffer memory areas on which such a data readout has been finished, four kiloword data of a next block are transferred from the fetch buffer memory XBUFA0–XBUFB3 in the above-mentioned manner. Thus, readout from the A-group buffer memory areas PBUFA0–PBUFA3 and from the B-group buffer memory areas PBUFA0–PBUFB3 are performed in an alternating fashion.

Modification of the Reproduction Mode

Description has thus far been made as if the two reproduction modes, interleave reproduction mode and segment reproduction mode were exclusive with respect to each other. But, the segment reproduction mode may contain an interleave reproduction process. Namely, in the case where the segment data SEG is made to select the segment reproduction mode for a simultaneous reproduction of plural data files, at least one of the plural data files to be simultaneously reproduced may contain waveform data of plural interleaved channels. To this end., it only suffices to provide proper interleave data ILD.

For further description, it is now assumed that the segment reproduction mode is selected which is intended for simultaneously reproducing two data files F1 and F2, and the data file F1 comprises data of three interleaved channels but the data file F2 comprises not-interleaved data. It is also assumed that the first, second and third channel waveform data of the interleaved data file F1 are assigned to tone generation channels CH0, CH1 and CH3, respectively, and the waveform data of the not-interleaved data file F2 are assigned to tone generation channel CH2.

Data transfer from the hard disk HD to the fetch buffer memory XBUFA0–XBUFB3 and further to the reproduction buffer memory PBUFA0–PBUFB3 is basically the same as that in the aforementioned segment reproduction mode.

As shown in FIG. 8B, the fetch buffer memory XBUFA0 –XBUFB3 is used as two memory areas A and B for each segment 0–3 (in total, eight memory areas XBUFA0–XBUFB3). However, since, in this case, there are only two data files to be reproduced, only the fetch buffer memory areas XBUFA0, XBUFB0, XBUFA1, XBUFB1 for two segments are actually used. For example, it is assumed that the data of the data file F1 are fetched into the buffer memory area XBUFA0, XBUFB0 for segment 0, and the data of the data file F2 are fetched into the buffer memory area XBUFA1, XBUFB1 for segment 1. On the other hand, the tone generation channels CH0–CH3 are all used and therefore all of the reproduction buffer memory areas PBUFA0–PBUFB3 are actually used.

In accordance with above-mentioned channel assignment procedure, the interleave data ILD is given when reading out 12 kiloword data (=one block=3 channels×4 kilowords) in such a manner that it takes a value "1" in correspondence to the three channels CH0, CH1, CH3. Thus, as may be apparent from the foregoing, the reproduction buffer memory areas PBUFA0–PBUFB3 corresponding to the channels CH0, CH1, CH3 can be sequentially designated, and the waveform data released from the interleaved state can be assigned to the respective designated memory areas. The interleave data ILD is also given when reading out one block=4 kiloword data from the fetch buffer memory XBUFA1, XBUFB1 for segment 1, in such a manner that it takes a value "1" in correspondence with the channel CH2. Thus, as may be apparent from the foregoing, the reproduction memory areas PBUFA2, PBUFB2 corresponding to the channel CH2 can be designated and the waveform data can be transferred to the designated areas.

Next, the reproduction process will be described in greater details.

Figure 17:
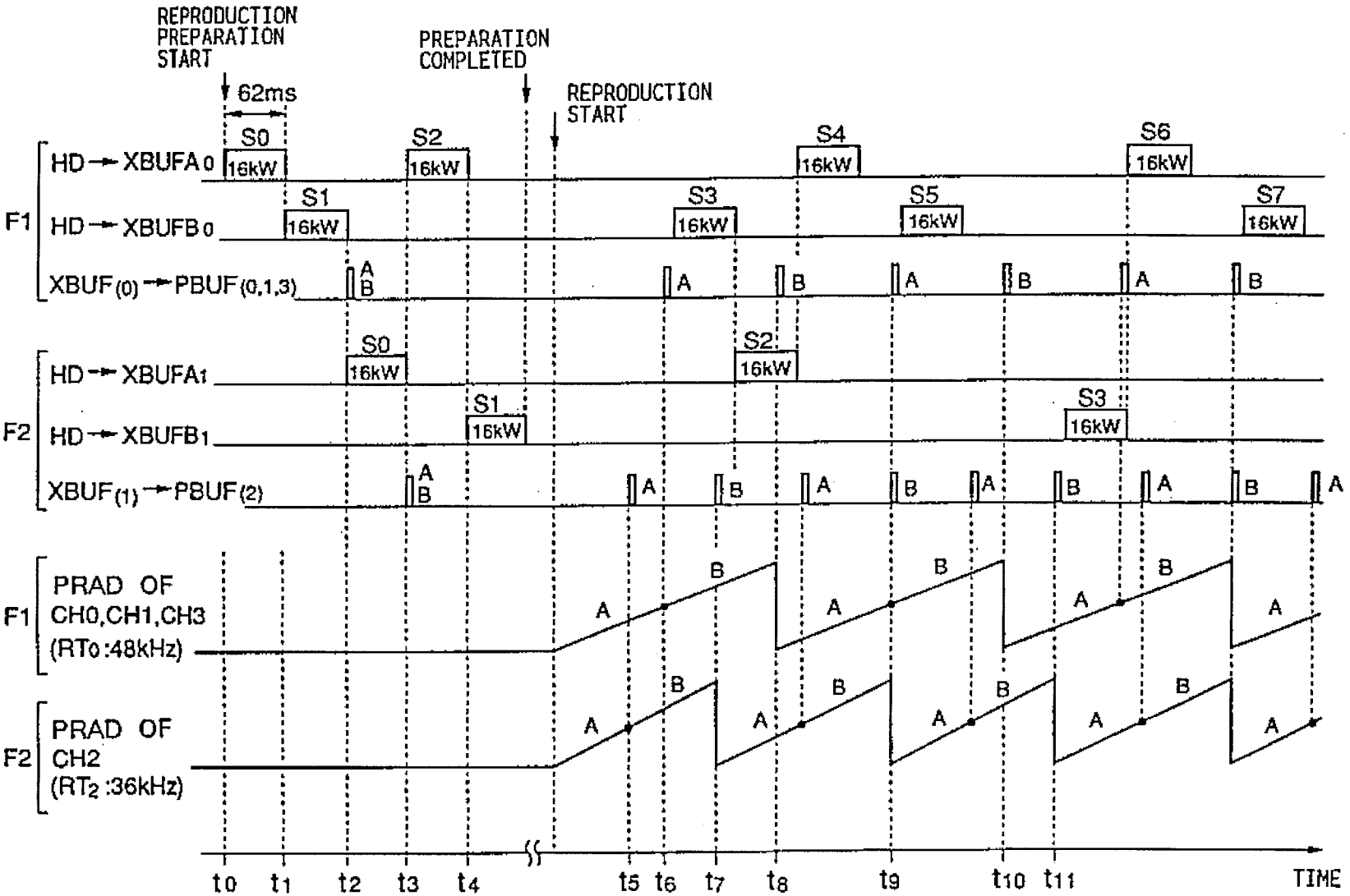
FIG. 17 is a timing chart illustrating data transfer timings for reproduction preparation and reproduction start in the case where plural data files are simultaneously reproduced.

FIG. 17 is a schematic diagram showing data transfer timings for reproduction preparation and subsequent reproduction start.

To first describe the reproduction preparation stage, 16 kiloword data of the 0th set S0 of the three-channel interleaved data file F1 are fetched from the hard disk HD into the buffer memory area XBUFA0 (see the neighborhood of time point t0). Then, 16 kiloword data of the first set S1 of the data file F1 are fetched from the hard disk HD into the buffer memory area XBUFB0 (see the neighborhood of time point t1). As mentioned previously, it takes 62 ms to fetch the 16 kiloword data from the hard disk.

Upon completion of the fetch, a process is made for transferring, while cancelling the interleave, one block (=4 kilowords) of data from the buffer memory XBUFA0, XBUFB0 to each of the channels CH0, CH1, CH3 of the reproduction buffer memory areas PBUFA0–PBUFB3 (see the neighborhood of time point t2). First, the data of the fist data block, i.e., 3 channels×four kilowords=12 kilowords are sequentially read out from the memory area XBUFA0 under the control of the above-mentioned read counter 53, and the read-out data are, under the control of the transfer write counter 58, assigned to the reproduction buffer memory areas PBUFA0, PBUFA1, PBUFA3 corresponding to channels CH0, CH1, CH3 designated by the interleave data ILD and stored into sequential addresses of the memory areas. Time required for this transfer is, as previously mentioned, 2.6 ms×3=7.8 ms. If, in this case, the data of the first block BK0 are separated between the 0th and first sets, the remaining data are also read out from the other fetch buffer memory area XBUFB0 and transferred to the reproduction buffer memory areas PBUFA0, PBUFA1, PBUFA3.

A similar process is then made to read the waveform data of the next block BK1 from the buffer memory areas XBUFA0, XBUFB0 and to transfer the read-out data to the other reproduction buffer memory areas PBUFA0, PBUFA1, PBUFA3 (see the neighborhood of time point t2).

The indication "XBUF (0)→PBUF (0, 1, 3)" in FIG. 17 represents a timing at which the data are transferred from one of the buffer memory areas XBUFA0 or XBUFB0 for segment 0 to one of the reproduction buffer memory area group PBUFA0, PBUFA1, PBUFA3 or PBUFB0, PBUF1, PBUF3 of channels CH0, CH1, CH3. Similarly, the indication "XBUF (1)→PBUF (2)" represents a timing at which the data are transferred from one of the buffer memory areas XBUFA1 or XBUFB1 for segment 1 to one of the reproduction buffer memory areas PBUFA2 or PBUFB2 of channel 2.

On the other hand, 16 kiloword data of the 0th set S0 of the data file F2 are fetched from the hard disk HD into the buffer memory area XBUFA1 (see the neighborhood of time point t2). Then, the waveform data of the first and second blocks BK0 and BK1 are transferred to and stored into the reproduction buffer memory areas PBUFA2, PBUFB2 corresponding to channel CH2 designated by the interleave data ILD (see the neighborhood of time point t3).

Thereafter, 16 kiloword data of the second set S2 of the data file F1 are fetched from the hard disk HD to the buffer memory area XBUFA0 (see the neighborhood of time point t3), and then 16 kiloword data of the first set S1 of the data file F2 are fetched from the hard disk HD to the buffer memory area XBUFA1 (see the neighborhood of time point t4).

When, in this manner, the waveform data of the first and second blocks BK0 and BK1 of the individual data files have been transferred to the respective A and B reproduction buffer memory areas PBUFA0–PBUFB3 corresponding to the tone generation channels CH0–CH3, the device is brought into the standby state. In this standby state, actuation of the reproduction start switch by the player starts a process for reading from the reproduction buffer memory areas PBUFA0–PBUFB3 through the reproduced sound generation section TG (FIG. 14), and thus simultanenous reproductive tone generation from the waveform data of the plural data files is initiated.

Further description will be made below on the assumption that the two data files F1, F2 to be simultaneously reproduced are of different sampling rates. If, for example, the data file F1 is of a 48 kHz sampling rate, the address counter 70 (FIG. 14) effects, at process time slots of the tone generation channels CH0, CH1, CH3, its address increment process using readout rate data RT0 corresponding to 48 kHz. If, on the other hand, the data file F2 is of a 36 kHz sampling rate, the address counter 70 effects, at process time slots of the tone generation channel CH2, its address increment process using readout rate data RT2 corresponding to 36 kHz. In FIG. 17, there are shown changes in the read address signal PRAD generated from the address counter 70 in accordance with the respective readout rate data. Reference characters A, B added in the figure indicate which of the reproduction buffer memory sections A and B is being accessed. One cycle of the address signal PRAD is 4 kW+4 kW=8 kilowords. As may be clearly seen, different readout rate data result in a difference in the incremental inclination of the address signal PRAD.

The fundamental operation of the data transfer process after the start of reproduced sound generation is to transfer new four kiloword waveform data to a reproduction buffer memory area on which readout of four kiloword waveform data has been completed and also to transfer new 16 kiloword waveform data from the hard disk HD to a fetch buffer memory area on which readout of 16 kiloword waveform data has been completed.

For example, at time point t5 of FIG. 17, readout of four kiloword waveform data from the A-group reproduction buffer memory area PBUFA2 of channel 2 is completed, and readout from the B-group reproduction buffer memory area PBUFB2 is ready to be performed next. So, after the readout from the A-group reproduction buffer memory area PBUFA2 has been completed, four kiloword waveform data of the next block BK2 are transferred from the buffer memory area XBUFA1 or XBUFB1 to the A-group reproduction buffer memory area PBUFA2.

Further, at time point t6 of FIG. 17, readout of respective four kiloword waveform data from the A-group reproduction buffer memory areas PBUFA0, PBUFA1, PBUFA3 of channels 0, 1 and 3 is completed, and readout from the B-group reproduction buffer memory areas PBUFB0, PBUFB1, PBUFB3 is ready to be performed next. So, after the readout from the A-group reproduction buffer memory area PBUFA0, PBUFA1, PBUFA3 has been completed, four kiloword waveform data of the next block BK2 are transferred from the buffer memory area XBUFB0 or XBUFA0 to the reproduction buffer memory areas PBUFA0, PBUFA1, PBUFA3.

By this time, transfer has been completed of the three-channel-interleaved waveform data for three blocks BK0, BK1, BK2 of the data file F1 or segment 0 (in total, 3×12=36 kilowords). The head portion of the 0th set includes heading data and other data than waveform data, and these non-waveform data, as mentioned previously, are not transferred to the reproduction buffer memory. The three-channel-interleaved waveform data for three blocks BK0, BK1, BK2 amounting to 36 kilowords are located in the 0th set through to the second set S2. Therefore, when the three-channel-interleaved waveform data of the third block BK2 have been transferred to the reproduction buffer memory areas PBUFA0, PBUFA1, PBUFA3, at least the waveform data of the first set stored in the fetch buffer memory area XBUFB0 have all been transferred already. So, it is allowed to fetch new waveform data into this buffer memory area XBUFB0.

So, after the waveform data of block BK2 have been transferred to the reproduction buffer memory areas PBUFA0, PBUFA1, PBUFA3 at time point t6, i.e., after the lapse of the transfer time (7.8 ms), 16 kiloword waveform data of the third set S3 of the data file F1 are transferred from the hard disk HD to the B-group buffer memory area XBUFB0.

At time point t7 of FIG. 17, readout of four kiloword waveform data from the B-group reproduction buffer memory area PBUFB2 of channel 2 is completed. So, after completion of the readout from the B-group reproduction buffer memory area PBUFB2, four kiloword waveform data of the next block BK3 are transferred from the buffer memory area XBUFA1 or XBUFB1 to the B-group reproduction buffer memory area PBUFB2.

By this time, transfer has been completed of the waveform data of four blocks BK0, BK1, BK2, BK3 in the data file F2 or segment 2 (in total, 4×4=16 kilowords). The head portion of the 0th set S0, as mentioned earlier, includes heading data and other data than waveform data, and so the 16 kiloword not interleaved waveform data of the four blocks BK0, BK1, BK2, BK3 are located in the 0th set to the first set S1. Therefore, when the waveform data of the fourth block BK3 have been transferred to the reproduction buffer memory area PBUFB2, at least the waveform data of the 0th set S0 stored in the fetch buffer memory area XBUFA1 have all been transferred already. So, it is allowed to fetch new waveform data into this buffer memory area XBUFA1. But, at this time point t7, the hard disk HD is still in the process of transferring the data of the data file F1, and hence the new waveform data are not fetch into the buffer memory area XBUFA1 at once. The 16 kiloword waveform data of the second set S2 in the data file F2 are fetched from the hard disk HD into the A-group fetch buffer memory area XBUFA1 for segment 1 after completion of data transfer of the data file F1 into the memory area XBUFB0.

At time point t8 of FIG. 17, readout of the respective four kiloword waveform data from the B-group reproduction buffer memory areas PBUFB0, PBUFB1, PBUFB3 of channels CH0, CH1, CH3 is completed. So, after completion of the readout from the B-group reproduction buffer memory areas PBUFB0, PBUFB1, PBUFB3, four kiloword waveform data of the next block BK3 are transferred from the buffer memory area XBUFA0 or XBUFB0 to the B-group reproduction buffer memory areas PBUFB0, PBUFB1, PBUFB3.

By this time, transfer has been completed of the three-channel-interleaved waveform data of four blocks BK0–BK3 in the data file F1 (in total, 4×12=48 kilowords), and at least the waveform data of the second set S2 stored in the A-group fetch buffer memory area XBUFA0 have all been transferred already. So, it is allowed to fetch new waveform data into this buffer memory area XBUFA0. However, since the hard disk HD is still in the process of transferring the data of the data file F2, the new waveform data are not fetch into the buffer memory area XBUFA0 at once but are fetched after the data transfer is over.

At time point t9 of FIG. 17, readout of the respective four kiloword waveform data from the A-group reproduction buffer memory areas PBUFA0, PBUFA1, PBUFA3 of channels CH0, CH1, CH3 is completed. So, after completion of the readout from these A-group reproduction buffer memory areas PBUFA0, PBUFA1, PBUFA3, four kiloword waveform data of the next block BK4 are transferred from the buffer memory area XBUFA0 or XBUFB0 to the reproduction buffer memory areas PBUFA0, PBUFA1, PBUFA3.

By this time, transfer has been completed of the three-channel-interleaved waveform data of five blocks BK0–BK4 in the data file F1 (in total, 5×12=60 kilowords), and at least the waveform data of the third set S3 stored in the B-group fetch buffer memory area XBUFB0 have all been transferred already. Therefore, it is allowed to fetch new waveform data into this buffer memory area XBUFB0, and so 16 kiloword data of the fifth set S5 in the data file F1 are transferred from the hard disk HD.

Substantially by the same time point t9, transfer has been also completed of four kiloword waveform data from the B-group reproduction buffer memory area PBUFB2 of channel CH2, and hence four kiloword waveform data of the next block BK5 are transferred from the memory area XBUFA1 or XBUFB1 to the B-group reproduction buffer memory PBUFB2. Because, as mentioned previously, the data transfer from the fetch buffer memory to the reproduction buffer memory is performed at time slots that are different from one segment to another, the data of segment 1 are transferred to the reproduction buffer memory area PBUFB2 only after the lapse of time (7.8 ms) required for the data of segment 0 to be transferred to the reproduction buffer memory area PBUFA0, PBUFA1, PBUFA3.

At time point t10 of FIG. 17, readout of the respective four kiloword waveform data from the B-group reproduction buffer memory areas PBUFB0, PBUFB1, PBUFB3 of channels CH0, CH1, CH3 is completed. So, after completion of the readout from these B-group reproduction buffer memory areas PBUFB0, PBUFB1, PBUFB3, four kiloword waveform data of the next block BK5 are transferred from the A-group buffer memory area XBUFA0 to the B-group reproduction buffer memory areas PBUFB0, PBUFB1, PBUFB3.

By this time, transfer has been completed of the three-channel-interleaved waveform data of six blocks BK0–BK5 in the data file F1 (in total, 6×12=72 kilowords). Assuming that the size of the heading data and other non-waveform data in the 0th set is less than eight kilowords, all the waveform data of the fourth set S4 stored in the A-group fetch buffer memory area XBOFA0 have not yet been transferred. Therefore, at this time point t10, data transfer from the hard disk HD to the buffer memory area XBUFA0 is not performed.

At time point t11 of FIG. 17, readout of the four kiloword waveform data from the B-group reproduction buffer memory areas PBUFB2 of channel CH2 is completed, and four kiloword waveform data of the next block BK7 are transferred from the memory area XBUFA1 or XBUFB1 to the B-group reproduction buffer memory area PBUFB2. By this time, transfer has been completed of the waveform data of eight blocks BK0–BK7 in the data file F2 (in total, 8×4=32 kilowords), and so at least the waveform data of the first set S1 stored in the fetch buffer memory area XBUFB1 have all been transferred already. Therefore, it is allowed to fetch new waveform data into this buffer memory area XBUFB1, and so 16 kiloword data of the third set S3 in the data file F2 are transferred from the hard disk HD to the buffer memory area XBUFB1 for segment 1.

Thereafter, in a similar manner to the above-mentioned, proper data transfer process will be performed in accordance with the progress of waveform data readout from the individual reproduction beuffer memory areas PBUFA0–PBUFB3.

Now, with reference to FIG. 18, description will be made on such a case where a reproduction process slightly different from the above-mentioned is carried out for the same data files F1, F2 as in the foregoing example. It is assumed that channel assignment of the waveform data of the data files F1, F2 is the same as in the foregoing.

Figure 18:
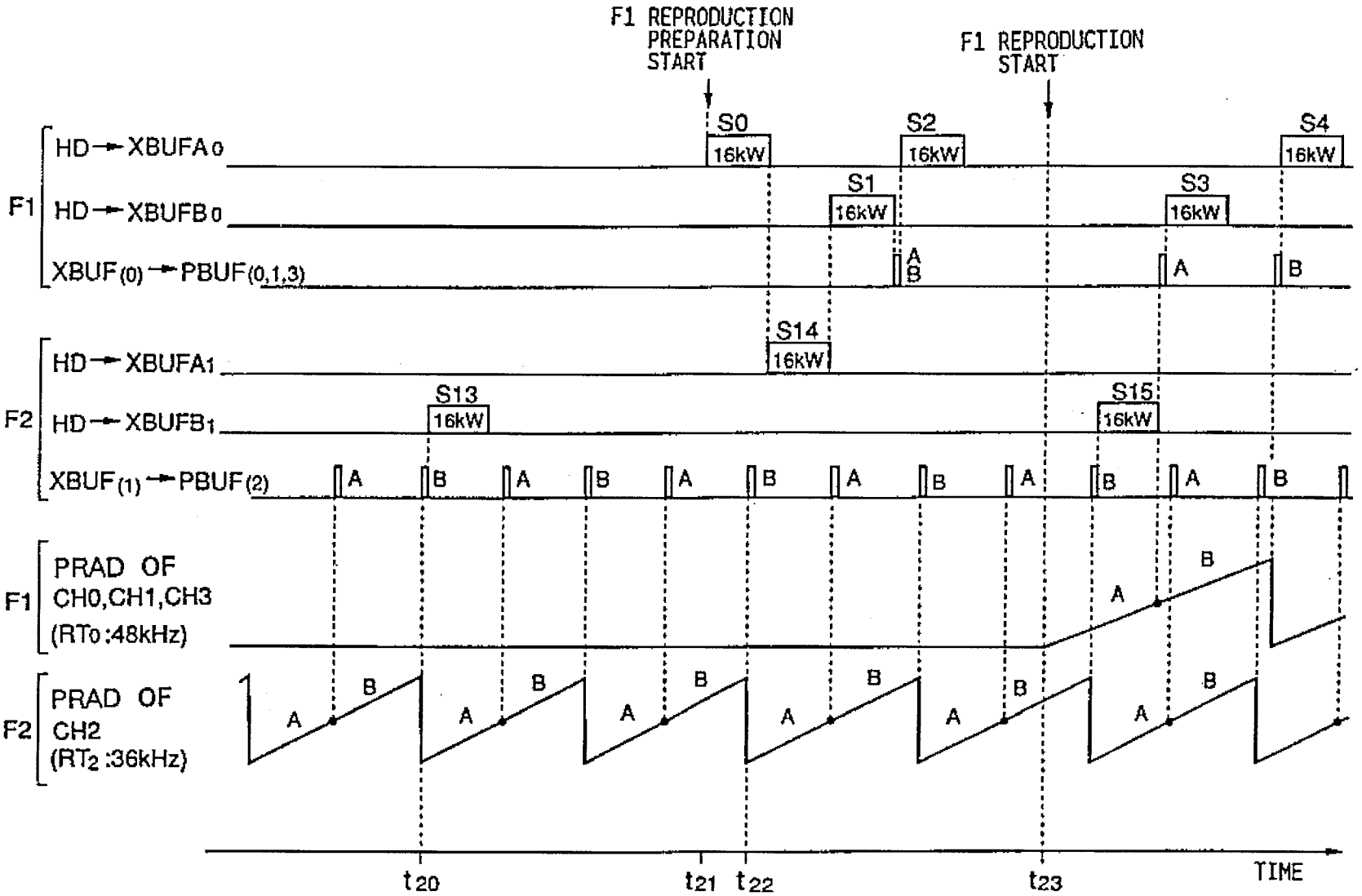
FIG. 18 is a timing chart illustrating data transfer timings in the case where, during reproduction of one data file, reproduction of another data file is started.

FIG. 18 illustrates exemplary data transfer timings in the case where, during the reproductive tone generation for the data file F2, reproductive tone generation for the data file F1 is initiated.

It is assumed here that, in order to reproduce the data file F2, readout of four kiloword waveform data from the B-group reproduction buffer memory PBUFB2 of channel CH2 is completed at time point t20 so that four kiloword waveform data of the next block are transferred from the memory area XBUF1 or XBUFB1 to the B-group reproduction buffer memory area PBUFB2, and then 16 kiloword waveform data of the 13th set in the data file F2 are fetched from the hard disk HD into the B-group fetch buffer memory area XBUFB1 for segment 1.

If it is instructed to prepare for reproduction of the data file F1 at time point t21, 16 kiloword waveform data of the 0th set S0 in the data file F1, as mentioned earlier, are first fetched from the hard disk HD into the A-group fetch buffer memory area XBUFA0 for segment 0. In the example of FIG. 17, the data of the first set S1 are transferred into the B-group buffer memory area XBUFB0 immediately after this, but the same is not entirely true with the example of FIG. 18.

Namely, in the example of FIG. 18, it is assumed that readout of four kiloword waveform data from the B-group reproduction buffer memory PBUFB2 of channel CH2 is completed while the data of the 0th set SO in the data file F1 are being fetched (time point t22), and 16 kiloword waveform data of the 14th set S14 in the data file F2 are ready for being fetched from the hard disk HD. So, in this case, arrangements are made such that data of data file F2 for which tone generation is being performed are fetched preferentially so as not to hinder the tone generation. Namely, after transfer of the data of the 0th set S0 in the data file F1 has been completed, the 16 kiloword waveform data of the 14th set in the data file F2 are fetched from the hard disk HD into the A-group fetch buffer memory area XBUFA1. Then, upon completion of fetch of the 14th set data, the data of the first set S1 in the data file F1 are fetched from the hard disk HD into the B-group fetch buffer memory area XBUFB0.

Therafter, in a manner similar to the above-mentioned, the waveform data of the first block BK0 are transferred from the memory area XBUFA0, XBUFB0 to channels CH0, CH1, CH3 of the A-group reproduction buffer memory PBUFA0–PBUFA3 while being released from the interleaved state, and also the waveform data of the next block BK1 are transferred to channels CH0, CH1, CH3 of the B-group reproduction buffer memory areas PBUF0–PBUFB3. After this, the 16 kiloword data of the second set S2 of the data file F1 are fetched from the hard disk HD into the buffer memory XBUFA0.

When the waveform data of the first and second blocks BK0, BK1, in the above-mentioned manner, have been transferred to the A-group and B-group reproduction buffer memory areas PBUFA0–PBUFB3 corresponding to the tone generation channels CH0, CH1, CH3 to which the waveform data of the data file F1 are assigned, the data file F1 becomes ready or standby for reproduction. In this standby state, upon actuation of the reproduction start switch by the player, a process for reproducing the data file F1 will be started and various processes are performed thereafter in a similar manner to the above-mentioned.

If an independent reproduction process is to be performed for each segment 0–3 in the segment reproduction mode as shown in FIG. 18, a particular instruction switch or the like is provided such that reproduction preparation start and reproduction start instructions may be given independently for each segment 0–3.

Modification of Data File Format

According to the data file format of FIG. 9, heading data, MIDI data and other control data are stored together in the head portion, and all waveform sample data (audio data) are successively stored in the following portion. This format, however, is not satisfactory in that MIDI data, control data and the like corresponding to the waveform sample data (audio data) for the entire tone generation period must be preserved in a suitable buffer memory, and thus the buffer memory must have a large storage capacity. This is particularly true with the case where each file has a great amount of waveform data (requiring a long tone generation time).

Figure 19:
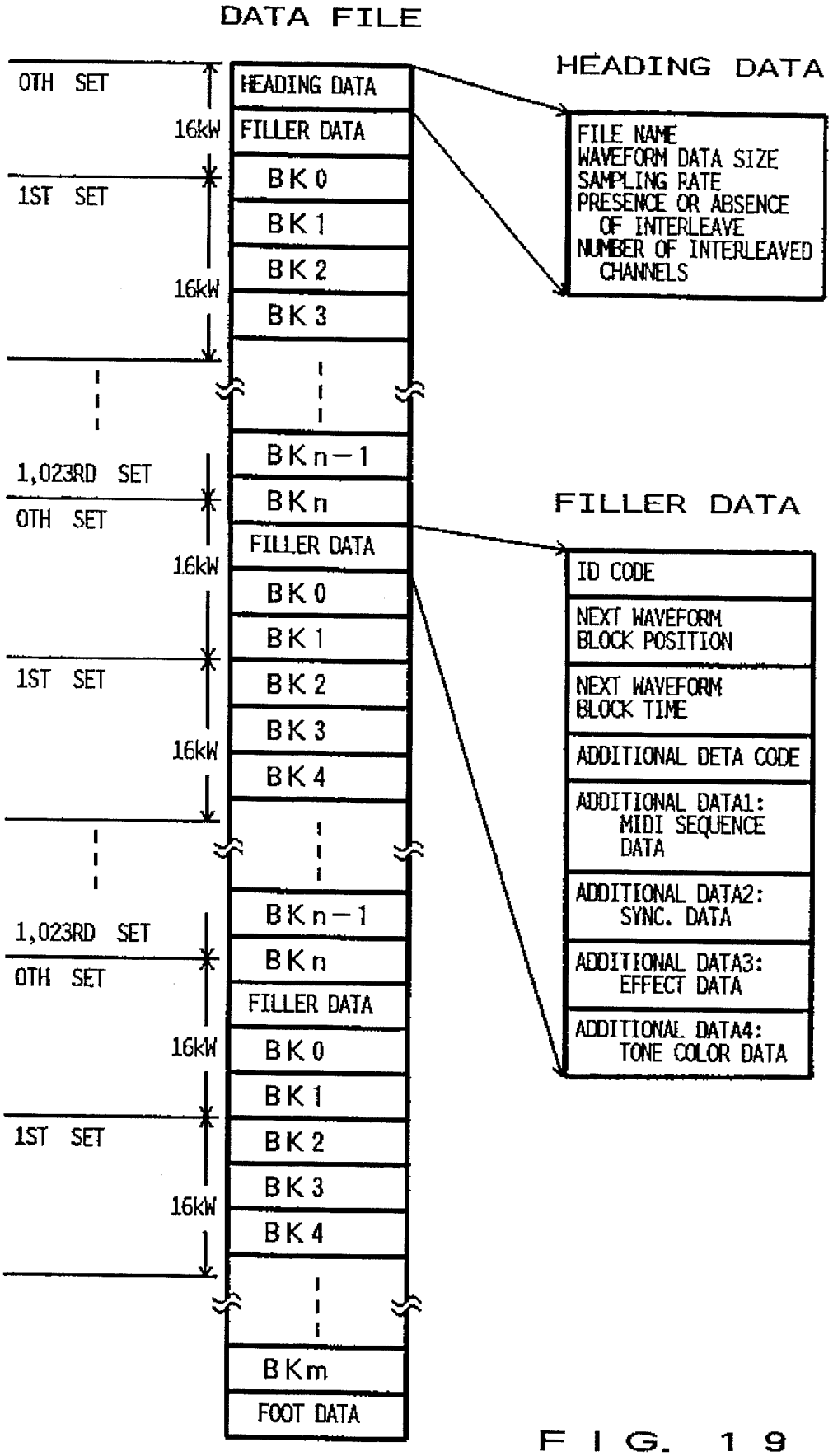
FIG. 19 illustrates another example of data format of a data file to be stored in the hard disk.

FIG. 19 shows another example of data format of one data file stored in the hard disk HD which is intended for solving the above-mentioned problem. In this example, one data file has a head portion at the top and a foot portion at the end. In the head portion, there are stored various data which indicate information common to all the waveform data of the data file, such as the file name, size of storing waveform data, sampling rate of the waveform data, presence or absence of interleave, and number of interleaved channels if any. The waveform sample data are stored between the head and foot portions with filler data being stored before each waveform sample data group which is composed of plural data blocks BKO–BKn.

The filler data includes various control data and MIDI data related to the following waveform sample data group having plural data blocks BK0–BKn. Namely, MIDI data and control data are stored, in a scattered manner, as the filler data for the individual waveform sample data groups. The storage location of each of the filler data corresponds to the location of the waveform sample data group which utilizes the filler data. Namely, the MIDI data and control data within the filler data are utilized for the waveform sample data group stored at following storage locations.

Now, more specific example of data making up the filler data will be described. The filler data comprises an identification code, next waveform block position data, next waveform block time data, additional identification code and other additional data. The identification code indicates what kind of data make up the filler data; it, for example, indicates presence or absence of the additional data. The next waveform data block position data indicates the head address position of the first waveform data block BK0 following the filler data and is used as a basis to retrieve the waveform data. The next waveform block time data is indicative of a tone generation time for the waveform sample data stored at the head address of the waveform data block BK0 following the filler data. This time data can be used for searching for data by the tone generation time or can be used for compensating for difference in the tone generation times when simultaneously reproducing waveform data of plural files (segments) that are of different sampling rates.

The additional data code indicates the address locations of each of the additional data and the size of the additional data. The additional data 1 is MIDI sequence data which is data indicative of an automatic performance sequence expressed in MIDI format. The additional data 2 is synchronization data which is used for synchronizing tone generation timings of the stored waveform sample data and the MIDI sequence data. For example, the additional data 2 is data for modifying the tempo or tone generation timing of the MIDI sequence data in accordance with the tempo of the stored waveform sample data. The additional data 3 is effect data for imparting performance effect to the audio data. The additional data 4 is tone color data for setting tone color of automatic performance tone provided by the MIDI sequence data. All of the above-mentioned four additional data need not be stored in the storage area of the corresponding filler data, but only some of the additional data that are actually necessary may be stored therein.

According to the embodiment, the storage area of the filler data is provided, one for every 1,024 data sets. Data group in one set comprises 16 kilowords=32 kilobytes just like the example of FIG. 9. The first filler data is stored following the head portion, and the waveform sample data (audio data) having plural blocks BK0–BKn are stored following the filler data. The size of one block of the waveform sample data is similar to that in FIG. 9, i.e., four kilowords for not-interleaved waveform data and four kilowords×number of interleaved channels for interleaved waveform data.

The last block of the storage area storing a total of 1,024 data sets (1,024×16 kilowords) from the 0th set to the 1,023rd set is block BKn. The end of the 1,023rd set does not necessarily correspond to the end of the last block BKn; it is more probable that the 1,023rd set ends in the middle of the last block BKn. In such a case, the remaining data are located in the head portion the 0th set of the next area, and the next filler data are stored after the end of the block BKn of the preceding area in the head portion of this 0th set. Following the filler data, there are stored plural blocks BK0–Bkn of waveform sample data (audio data).

In this manner, the filler data is stored before each of the waveform sample data group composed of plural blocks BK0–BKn. The number of data sets in the last waveform sample data group is less than 1,024 so that the data group ends as tone generation of the audio data in this data file is completed. Accordingly, in most cases, the number m of the last block BKm may be smaller than the number n of the last block BKn in the 1,023rd set. In the very last foot portion, there is stored data indicative of the end of the data file.

Figure 20:
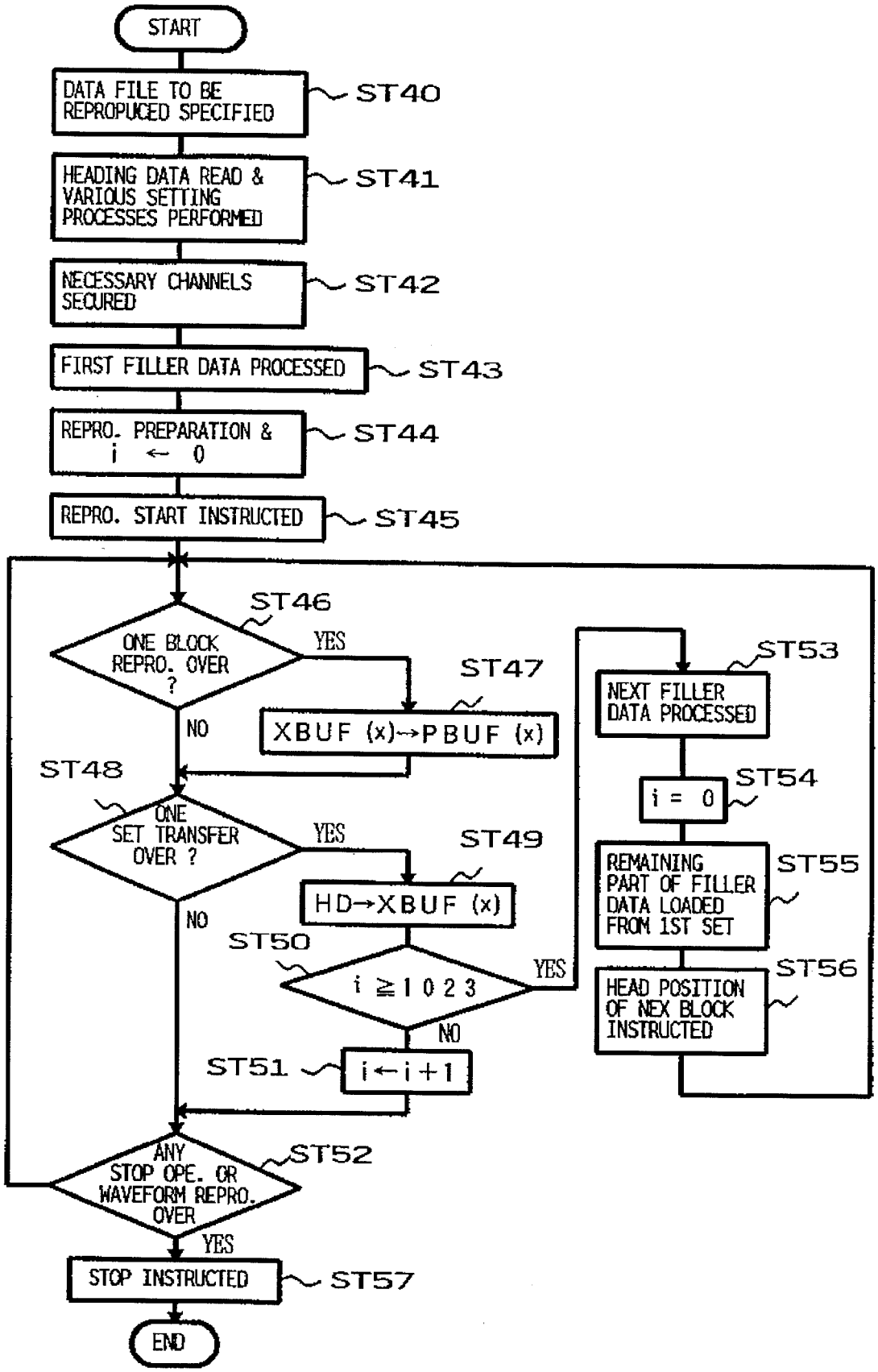
FIG. 20 is a flowchart illustrating a modification of reproduction process executed by the personal computer shown in FIG. 15.

Description on a Reproduction Process in the Case Where the Filler Data are Stored Even in the case where data files stored in the hard disk HD are in the data format as shown in FIG. 19, the respective components may be arranged and controlled in a similar manner to those shown in FIGS. 1–14, except that process programs of the personal computer PC must be modified to some extent in consideration of the presence of the filler data. FIG. 20 illustrates such a modified example of the reproduction process program of the personal computer PC, which is intended for a reproduction process in consideration of the presence of the filler data.

Reproduction process by the personal computer PC will now be described with reference to FIG. 20. First, a process to specify data file to be reproduced (step ST40) is performed. In this step, one or more data file to be reproduced are specified on the basis of the player's data file selection.

Then, the personal computer PC accesses the hard disk HD to load various data in the head portion of the specified data file, and it performs various processes on the basis of the loaded data (step ST41). For example, the personal computer PC, in a manner to the above-mentioned, reads sampling rate data and delivers the rate data to the record/reproduction control device RU via the serial communication bus SRB.

Next, an channel assignment process is carried out for securing necessary tone generation channel in correspondence with the interleave state in the specified data file (step ST42). If the specified data file is not interleaved, a channel assignment process is carried out for securing one tone generation channel. If, on the other hand, the specified data file is interleaved, the channel assignment process is carried out for securing a specific number of the tone generation channels corresponding to the number of interleaved channels. Interleave data ILD is given in accordance with the result of this channel assignment.

The channel assignment method, as mentioned previously, may be selected from among any suitable methods. If, in this case, there is not the necessary number of unused channels, this process may be made in accordance with a given suitable rule. For example, the waveform data transfer from the hard disk HD may be cancelled as an error, or a predetermined truncating process may be carried out such that relatively old assignment to a channel being currently used is compulsorily cancelled to secure a channel for a new assignment. Another channel assignment method may be such that, when entering a reproduction command, the player also designates which file should be assigned to which channel. Still another channel assignment method may be such that channel assignment instructing data is also included in heading data of each file so that the channel assignment is carried out in accordance with such data.

Subsequently, the first filler data stored immediately after the head portion is loaded into the RAM provided within the personal computer PC, and necessary process for utilizing this filler data is carried out (step ST43).

Then, preparatory process for reproducing the designated data file is carried out, and at the same time data set management register i is set to an initial value of 0 (step ST44). In the preparatory process which is a process performed prior to the initiation of the reproduction that has been described earlier with reference to FIGS. 17 and 18, the data of the 0th and first sets are fetched into both of the fetch buffer memory sections XBUFA, XBUFB, and also the waveform data of the first two blocks BK0, BK1 are transferred to both of the reproduction buffer memory sections PBUFA, PBUFB.

In this case, the head position of the waveform data of the first block BK0 stored after the filler data can be identified by the "next waveform block position data" contained in the filler data, and therefore the stored position of the waveform data of the block BK0 is instructed to the record/reproduction control device RU on the basis of this waveform block position data. In response to this, the record/reproduction control device RU excludes the headind data and filler data from the 0th set data stored in the fetch buffer memory section XBUFA so that the waveform data of the block BK0 are properly taken out and transferred to the reproduction buffer memory section PBUFA. Because the waveform data of the following blocks BK1, BK2 . . . are transferred 4 kilowords at a time, the record/reproduction control device Ru can carry out the data transfer for the following blocks BK1, BK2 . . . without receiving any further particular instructions from the personal computer PC.

Then, once reproduction start instruction has been given by the player, the personal computer PC gives a reproduction start command to the record/reproduction control device RU so as to cause the reproduced sound generation section TG to initiate its reproduced sound generation operation (step ST45). Further, in response to the reproduction start instruction, the personal computer PC starts reading out the MIDI sequence data in the filler data loaded into the RAM. The thus read-out automatic performance sequence data prepared in MIDI format are supplied through an unillustrated MIDI cable to an unillustrated musical instrument which is adapted for utilizing the MIDI data to produce automatic performance tones. In this way, an automatic performance by the MIDI musical instrument can be effected simultaneously with the reproductive tone generation from waveform data by the reproduced sound generation section TG.

Thereafter, at each break between the data transfer processes, the personal computer PC checks the presence or absence of an interrupt signal given from the record/reproduction control device RU (or generated within the personal computer PC) and performs necessary process in response to the arrival or generation of the interrupt signal.

First, in step ST46, the personal computer PC checks the presence or absence of a one-block-reproduction-time interrupt signal that is given each time reproductive readout of one block, i.e., 4 kiloword waveform data from any of the reproduction buffer memory areas PBUFA0–PBUFB3 is completed. If such an interrupt signal is present, the program advances to step ST47 in which next block 4 kiloword waveform data are transferred to any of the reproduction buffer memory areas (PBUFF (x)) where one block readout has been completed, from any of fetch buffer memory ares (XBUF(x)) corresponding thereto. Details of the data transfer in such a case have already explained above with reference to FIGS. 17 and 18.

In next step ST48, the presence of a one-set-transfer-end-time interrupt signal is checked which is generated when one set, i.e., 16 kiloword waveform data have been transferred from any of the fetch buffer memory areas XBUFA0–XBUFB3. If the check result is affirmative, the program advances to step ST49 in which 16 kiloword waveform data of the next one block are loaded from the hard disk HD to any of the fetch buffer memory areas (XBUFF (x)). Details of the data transfer in such a case have already explained above with reference to FIGS. 17 and 18.

In next step ST50, it is determined whether or not the value of the data set management register i has reached the maximum set value 1,023. If the determination result is negative, the program advances to next step 51 to increment the value of the register i by one and then advances to step 52. In the step 52, it is determined whether there has been given an interrupt signal based on a reproduction stop operation, or an interrupt signal based on a termination of readout and reproduction of the entire waveform data in the data file. If the determination result is NO, then the program goes back to step ST46.

Thus, into the register i is stored the number of data sets having been transferred from the hard disk HD to the fetch buffer memory XBUFA0–XBUFB3.

When the waveform data of the last, 1,023rd set have been transferred to the fetch buffer memory area XBUFF(x), the value of the register i at the time of determination in step ST50 is still 1,022 and the determination result in step ST50 is still NO, and so the program goes to step ST51 to set the value of the register i to 1,023.

Subsequently, the determination condition "i≧1,023" is satisfied in step ST50 when the 0th set data have been loaded into any of the reproduction buffer memory areas XBUF(x), and then the program goes to step ST53. In this step ST53, the filler data stored in the 0th set (see FIG. 19) is loaded from the hard disk HD into the RAM within the personal computer PC, and necessary process is performed for utilizing the filler data. In next step ST54, the value of the data set management register i is set to the initial value of 0.

Next step ST55 is a process that is performed in the case where the filler data is stored across two data set (namely, the 0th and first set). If NO (namely, if the filler data is stored only in the 0th set), the program jumps step ST55 to step ST56. In step ST55, the remaining part of the filler data is loaded from the next data set, namely, first set into the RAM.

In step ST56, the personal computer PC instructs the head storage position of the waveform data of the first block BK0 stored after this filler data to the record/reproduction control device RU. As previously mentioned, the head storage position of the waveform data of the first block BK0 is identified by the next waveform block position data contained in the filler data. On the basis of such instructions, the record/reproduction control device RU can exclude the filler data from the 16 kiloword data of the 0th set loaded in to fetch buffer memory XBUF and designates the head storage position of the waveform data of the first block BK0 by start address data STA.

Thereafter, the program goes back to step ST46 to repeat the above-mentioned processes.

Once the reproduction stop operation has been effected, or reproductive readout of the entire waveform data of the data file has been completed, the determination result in step ST52 becomes YES, and stop instruction is given in step ST57. In response to the stop instruction, the reproduced sound generation section TG of the record/reproduction control device RU stops the tone generation process in channel to which the waveform data of the data file are assigned. Further, if necessary, the personal computer PC may also cause the automatic performance based on the MIDI sequence data to be stopped.

It should be understood that the data to be recorded and reproduced in accordance with the principle of the present invention are not constrained to waveform data but may be other tone data (namely, all kinds of data related to musical sound).

It should also be understood that coding of the waveform sample data (audio data) may be done not only by PCM but also by any other coding technique such as DPCM, ADPCM, DM, and ADM.

As has thus far been described, according to the present invention, a record/reproduction control device is connected to a mass storage device for direct access thereto which is managed by a host control device. The record/reproduction control device receives from the host control device write or read instructions on the basis of which it performs its own process to write to or read from the mass storage device. Therefore, a burden on the host control device can be reduced to a considerable degree. In consequence, the host control device can execute various other additional functions such as a sequencer automatic performance function or a computer graphic function associated with a music piece performed, which is very economical and achieves enhanced functions during a reproductive performance.

Further, because tone data read out from the mass storage device is temporarily fetched into a first buffer memory, from which the tone data is transferred to a second buffer memory, and then, the tone data thus stored in the second buffer memory is read out at a desired readout rate, arrangements suitable for both data fetch from the mass storage device and reproductive readout can be provided and thus it is made possible to effectively simplifying the reproduction systems employed.

Furthermore, because the interleaved state of the tone data can properly be cancelled at the time of reproduction, data composed of interleaved waveform data of plural channels can not only be stored into the mass storage device but also be simultaneously reproduced in a proper manner.

Moreover, because tone data of plural data files recorded in the mass storage device are read out in predetermined units and stored into the buffer memory so that reproductive tone generation is achieved by reading out the respective tone data of the data files, the tone data of plural data files recorded in the mass storage device can be simultaneously reproduced. Therefore, by selecting various combinations of the data files, a wide variety of reproductive performances can be achieved.

Moreover, it is possible to select either a first reproduction mode for reproducing a data file having tone data of plural channels recorded in an interleaved state, or a second reproduction mode for permitting a simultaneous reproduction of plural data files having not-interleaved tone data recorded, and the tone data transfer from the first buffer memory to the second buffer memory is properly controlled depending on which of the reproduction modes is selected. In this way, with a very simple arrangement, it is made possible to perform a versatile reproduction process that properly deals with the two different reproduction modes.

Moreover, because arrangements are made such that non-waveform data (such as MIDI data) are dispersedly stored between tone waveform data or audio data in a data file, only necessary amount of the non-waveform data can be retrieved at necessary times in time series of reproductive tone generation and therefore buffer storage means for this purpose can be of a relatively small capacity. In addition, because only the waveform data are separately retrieved and stored into the reproduction buffer memory and this reproduction buffer memory is accessed for reading out the waveform data, successive tone generation can be safely guaranteed without any troubles, even though the non-waveform data are stored between the individual waveform data groups.

What is claimed is:

1. A tone data recording and reproducing device which comprises:

a storage device storing a data file having tone data of plural channels recorded in an interleaved state;

a first buffer memory into which the tone data read out from said storage device is fetched;

interleave cancellation means for reading out the tone data from said first buffer memory and releasing the read-out tone data from the interleaved state so as to provide separate tone data for each of the channels;

a second buffer memory for storing, separately for each of the channels, interleaved-state-released tone data provided from said interleave cancellation means; and readout means for reading out the tone data stored in said second buffer memory.

2. A tone data recording and reproducing device which comprises:

a storage device storing plural data files each having tone data recorded therein;

means for selecting either of a first mode for reproducing the data file having tone data of plural channels recorded therein in an interleaved state, and a second mode for permitting a simultaneous reproduction of plural data files each having not-interleaved tone data recorded therein;

a first buffer memory to which the tone data read out from said storage device is fetched;

a second buffer memory having plural predetermined storage areas;

first transfer control means for, in said first mode, reading out the tone data from said first buffer memory and releasing the read-out tone data from the interleaved state, so as to cause interleaved-state-released tone data to be stored into respective storage areas of said second buffer memory separately for each of the channels;

second transfer control means for, in said second mode, reading out the tone data of the individual data files from said first buffer memory so as to store the read-out tone data into the respective store areas of said second buffer memory; and readout means for reading out the tone data stored in the respective storage areas of said second buffer memory.

3. A tone data recording and reproducing device which comprises:

first memory means storing tone waveform data of plural sounds in an interleaved state;

assignment channel designation means for designating reproduction channels to which interleaved tone waveform data of the plural sounds should be assigned;

second memory means for storing tone waveform data for each of the reproduction channels;

interleave cancellation means for reading out the tone waveform data from said first memory means to release the read-out data from the interleaved state, and distributing the interleaved-state-released tone waveform data of the individual sounds in correspondence to the channels designated by said channel designation means so as to write the tone waveform data into said second memory means; and readout means for reading out the tone waveform data stored in said second memory means, independently for each of the reproduction channels.

4. A tone data recording and reproducing device which comprises:

first memory means storing tone waveform data of plural sounds in an interleaved state;

interleave cancellation means for rapidly reading out a part of the tone waveform data stored in said first memory means to release the read-out data from the interleaved state;

second memory means for storing tone waveform data for each channel; and readout means for, for each reproduction channel, reading out the tone waveform data stored in said second memory means at a predetermined readout rate.

5. A tone data recording and reproducing device which comprises:

first memory means storing tone waveform data of plural sounds in an interleaved state;

second memory means for storing tone waveform data for each of a predetermined number of reproduction channels:

channel designation means for setting time-divisional time slots that are equivalent in number to the interleaved sounds and designating individual reproduction channels in correspondence to the time slots;

interleave cancellation means for reading out the tone waveform data from said first memory means to release the read-out data from the interleaved state in correspondence to the time slots, and distributing the interleaved-state-released tone waveform data to the reproduction channels designated in correspondence to the time slots so as to write the tone waveform data into said second memory means; and readout means for reading out the tone waveform data stored in said second memory means.

6. A tone data recording and reproducing device which comprises:

first storage means storing plural data files each having tone waveform data recorded therein, some of the data files having tone waveform data of plural sounds recorded therein in an interleaved state, other data file having not-interleaved tone waveform data recorded therein;

selection means for selecting data file to be reproduced, said selection means permitting a selection of a plurality of the data files;

second storage means;

readout control means for reading out from said first storage means the tone waveform data of a data file selected by said selection means, so as to store the read-out data into said storage means;

channel designation means for designating reproduction channels through which tone generation for the selected data file should be effected, said channel designation means, in the case of said data file having tone waveform data of plural sounds recorded in an interleaved state, designating a necessary number of the channels corresponding to the number of interleaved sounds;

third storage means provided in corresponding relation to the reproduction channels;

transfer control means for, for each of the data filed, reading out the tone waveform data stored in said second storage means to store the read-out data into said third storage means in correspondence to the designated reproduction channels, said transfer control means, in the case of said data file having tone waveform data of plural sounds recorded in an interleaved state, releasing the tone waveform data from the interleaved state so as to store interleaved-state-released data into said storage means in correspondence to the designated reproduction channels; and readout means for, for each of the reproduction channels, reading out the tone waveform data stored in said third storage means at an independent readout rate.

* * * * *